US005187918A

United States Patent [19]

Gerrans

[11] Patent Number: 5,187,918

[45] Date of Patent: Feb. 23, 1993

[54] SLIDE MOUNTER WITH BRIDGING FILM ADVANCE

[75] Inventor: Wilbur Gerrans, Marysville, Wash.

[73] Assignee: Pakon, Inc., Minnetonka, Minn.

[21] Appl. No.: 822,188

[22] Filed: Jan. 15, 1992

[51] Int. Cl.[5] ..... B65B 5/04; B65B 63/00; B65B 61/06

[52] U.S. Cl. ..... 53/435; 53/520; 53/284.2; 83/278; 83/948

[58] Field of Search ..... 53/435, 520, 284.2, 53/77, 284.4; 83/221, 222, 278, 948, 373, 399, DIG. 1

[56] References Cited

U.S. PATENT DOCUMENTS

| | | | |
|---|---|---|---|
| 3,141,276 | 7/1964 | Anderson et al. | 53/520 |
| 3,521,423 | 7/1970 | Koeppe et al. | 53/284.2 |
| 3,524,299 | 8/1970 | Mundt et al. | 53/435 |
| 3,611,858 | 10/1971 | Beatty et al. | 83/222 X |
| 3,776,078 | 12/1973 | Perlman | 83/221 X |
| 3,788,031 | 1/1974 | Florjancic | 53/520 |
| 3,977,280 | 8/1976 | Mundt et al. | 83/42 |
| 3,992,243 | 11/1976 | Berggren et al. | 53/520 X |
| 4,003,187 | 1/1977 | Kiejzik | 83/373 X |
| 4,004,340 | 1/1977 | Urban | 53/435 X |
| 4,102,029 | 7/1978 | Thompson | 53/435 X |
| 4,135,343 | 1/1979 | Urban et al. | 53/435 |
| 4,237,678 | 12/1980 | Thompson | 53/284.2 X |
| 4,256,527 | 3/1981 | Green | 53/520 X |
| 4,331,260 | 5/1982 | Euteneuer et al. | 53/284.2 X |
| 4,345,707 | 8/1982 | Urban et al. | 226/68 |
| 4,355,748 | 10/1982 | Willenbring | 226/67 |
| 4,391,082 | 7/1983 | Diesch | 53/520 |
| 4,516,386 | 5/1985 | Willenbring | 53/520 |
| 4,543,771 | 10/1985 | Jensen et al. | 53/520 |
| 4,603,539 | 8/1986 | Müssig et al. | 53/435 |
| 4,612,754 | 9/1986 | Neuhold et al. | 53/284.2 X |
| 4,673,815 | 6/1987 | Fruth et al. | 250/548 |
| 4,698,883 | 10/1987 | Blättner et al. | 53/520 X |
| 4,738,040 | 4/1988 | Neuhold et al. | 40/152 |

*Primary Examiner*—Horace M. Culver
*Attorney, Agent, or Firm*—Kinney and Lange

[57] ABSTRACT

The present invention relates to an apparatus for advancing a photographic film web for operation in a semi-automatic or automatic slide mounter. The apparatus advances the film for operation across a knife assembly to position the film with upper and lower knife blades of the knife assembly to sever a film transparency from the photographic film web to prepare a photographic slide. The apparatus includes a shuttle bridging mechanism for supporting the film, movable between a retracted position, out of alignment with the knife blades and an advanced position, extending across a support gap defined at the upper and lower knife blades. The shuttle bridging mechanism is advanced during operation to the advanced position and the film is advanced until a trailing edge of a leading film transparency aligns with the upper and lower knife blades. When the film is in place across the upper and lower knife blades, the shuttle bridging mechanism is retracted to permit the upper and lower knife blades to close to sever the film transparency.

17 Claims, 19 Drawing Sheets

17

165A
42
165
411
322A
322
412
413
414
392
292
354
358
294
356
352
160
357
342
344
168
330
106
30
110
45
162
182
175
184
180
190
334
390
334
475
338
378
377
336
334
335
195
495
497
104
342
168
332
344
496
375
390

35
10
132
130
25
15
140
17
404
405
300
404A
403
401
400
42
402
45
322
322A
110
392
295
280
497
390
375
180
496
195
294
160
495
292
190
475
106
104
175
165

SLIDE MOUNTER WITH BRIDGING FILM ADVANCE

REFERENCES TO CO-PENDING APPLICATIONS

Reference is made to the following commonly assigned applications which were filed on even date with this application and are entitled a follows:

(1) Slide Mounter with Spring Loaded Insert Guides (Ser. No. 821,999); (2) Slide Mounter with Movable Knife Assembly (Ser. No. 821,025); (3) Slide Mounter with Motor/Arm Interlock (Ser. No. 821,752); (4) Slide Mounter with In-Plane Film Pusher (Ser. No. 821,762); (5) Slide Mounter with Positive Stop Film Placement (Ser. No. 822,029); and (6) Slide Mounter with Improved Slide Mount Advance (Ser. No. 820,988). All of the above applications ere filed on Jan. 15, 1992.

BACKGROUND OF THE INVENTION

The present invention relates to slide mounter for preparing photographic slides for use with a slide projector. More specifically, the present invention relates to an apparatus for advancing a photographic film web for operation in semi-automatic or automatic slide mounters.

In semi-automatic and automatic slide mounters, individual film transparencies are severed from a photographic film web and inserted into a slide mount. The film transparencies are severed from the photographic film web by a knife assembly formed of upper and lower blades designed to operate between a closed cutting position and an opened receiving position. Typically, the film web is mechanically advanced across the knife blades from a supported position along a film track while the knife assembly is in the opened receiving position. When a trailing edge of a leading film transparency of the film web is properly positioned, the upper and lower blades are closed together to sever the film transparency from the film web. The severed film transparency is then inserted into a slide mount to complete the photographic slide.

The design of the knife assembly defines a support gap across which the film must be advanced to align the trailing edge of the leading film transparency with the upper and lower knife blades. In typical past applications, the film has been advanced along a roller slide support to advance the film transparency across the support gap of the knife assembly for operation. However, in such applications, the leading edge of the film is advanced forward across the support gap without support. Since the leading edge is advanced unsupported it is often difficult to guide the film transparency across the support gap of the knife assembly. This is particularly so since the film transparency has a tendency to curl because the film web is originally wrapped around a storage reel. Thus, when advanced unsupported, the film transparency has a tendency to want to return to its originally wrapped position. Also, the emulsion with which the photographic film is coated causes the film transparency to curl along the direction of advancement of the film transparency across the support gap of the knife assembly. The propensity of the film transparency to curl is further aggravated by the advancement force which is used to advance the film for operation.

Thus, there has been a continuing need to develop an apparatus which will consistently advance, without difficulty, the film web across the knife support gap to align the trailing edge of a leading film transparency with the upper and lower blades of the knife assembly. That is, there has been a continuing need to develop a mechanism for operation with an automatic or semi-automatic slide mounter that will advance the film and which will not cause the film to curl along the direction of advancement and thus interrupt the continuous operation of the slide mounter.

SUMMARY OF THE INVENTION

The present invention relates to an apparatus for advancing a photographic film web for operation in semi-automatic or automatic slide mounters. The apparatus includes a shuttle bridging mechanism which is designed to operate between a retracted position, out of alignment with the knife blades of the knife assembly, and an advanced position extending across the support gap defined at the upper and lower blades of the knife assembly to support the film thereacross. The photographic film web is supported for operation by the shuttle bridging mechanism and is movable therewith. During operation, the shuttle bridging mechanism advances from the retracted position to the advanced position to support the film across the support gap and the film is further advanced until a trailing edge of the leading film transparency is aligned with the upper and lower blades of the knife assembly. Thereafter, the shuttle bridging mechanism is moved to the retracted position to permit operation of the knife assembly in the closed cutting position to sever the leading film transparency from the photographic film web.

BRIEF DESCRIPTION OF THE DRAWINGS

The invention will be further described with reference to the accompanying drawings where like numbers refer to like parts in several views.

FIG. 3 is a perspective view, similar to FIG. 2, showing the movable knife assembly adjusted for operation with the supported film.

While the above identified drawing figures set forth a preferred embodiment, other embodiments of the present invention are also contemplated. In all cases, this disclosure presents an illustrated embodiment of the present invention by way of representation and not limitation. It should be understood that numerous other modifications and embodiments can be devised by those skilled in the art which fall within the scope and spirit of the principles of this invention. It should be noted that the figures may not been drawn to scale.

DETAILED DESCRIPTION OF THE PREFERRED EMBODIMENT

Figure 1:
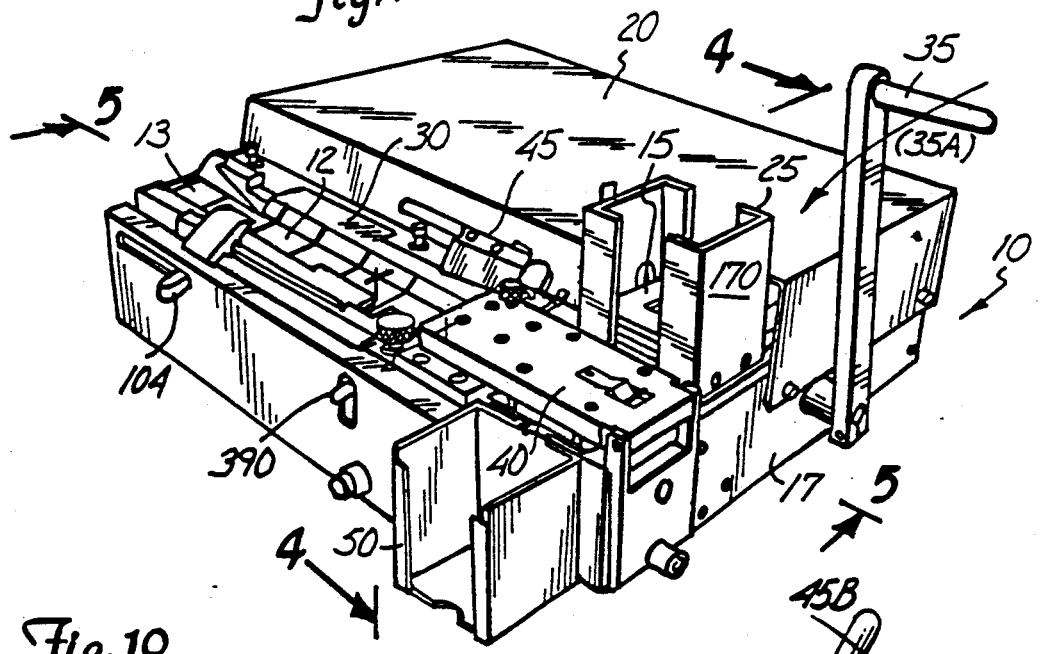
FIG. 1 is a perspective view of a photographic slide mounter of the present invention.

(1) Overview of Slide Mounter (FIG. 1)

FIG. 1 shows a semi-automatic slide mounter 10 which is used to sever individual film transparencies 12 from a photographic film web 13 for insertion into a slide mount 15 to prepare a photographic slide. The slide mounter 10 includes a base frame 17 and a cover 20. The slide mounts 15 are stored in stacked relation in a slide magazine 25. The photographic film web 13 is supported for movement along a film path 30.

An operating lever 35 initiates the operation of the slide mounter 10. In operation, the operating lever 35 is advanced forward (arrow 35A) to eject a slide mount 15 from the slide magazine 25. The ejected slide mount 15 is advanced to an insertion station 40. A motorized drive assembly 42 (shown in FIG. 8A) is synchronized with the operating lever 35 to advance the film web 13 along the film path 30 toward the insertion station 40. A knife assembly 45 aligned with the film path 30 is used to sever individual film transparencies 12 from the film web 13. Each time the operating lever 35 ejects a slide mount 15, the motorized drive 42 (FIG. 8A) advances the film web 13 along the film path 30, a leading film transparency 12 is severed, and the severed film transparency 12 is inserted into the ejected slide mount 15. An operation cycle of the motor assembly 42 begins each time the operating lever 35 is released from a forward position. A catch magazine 50 holds the photographic slides after each is prepared.

Figure 2:
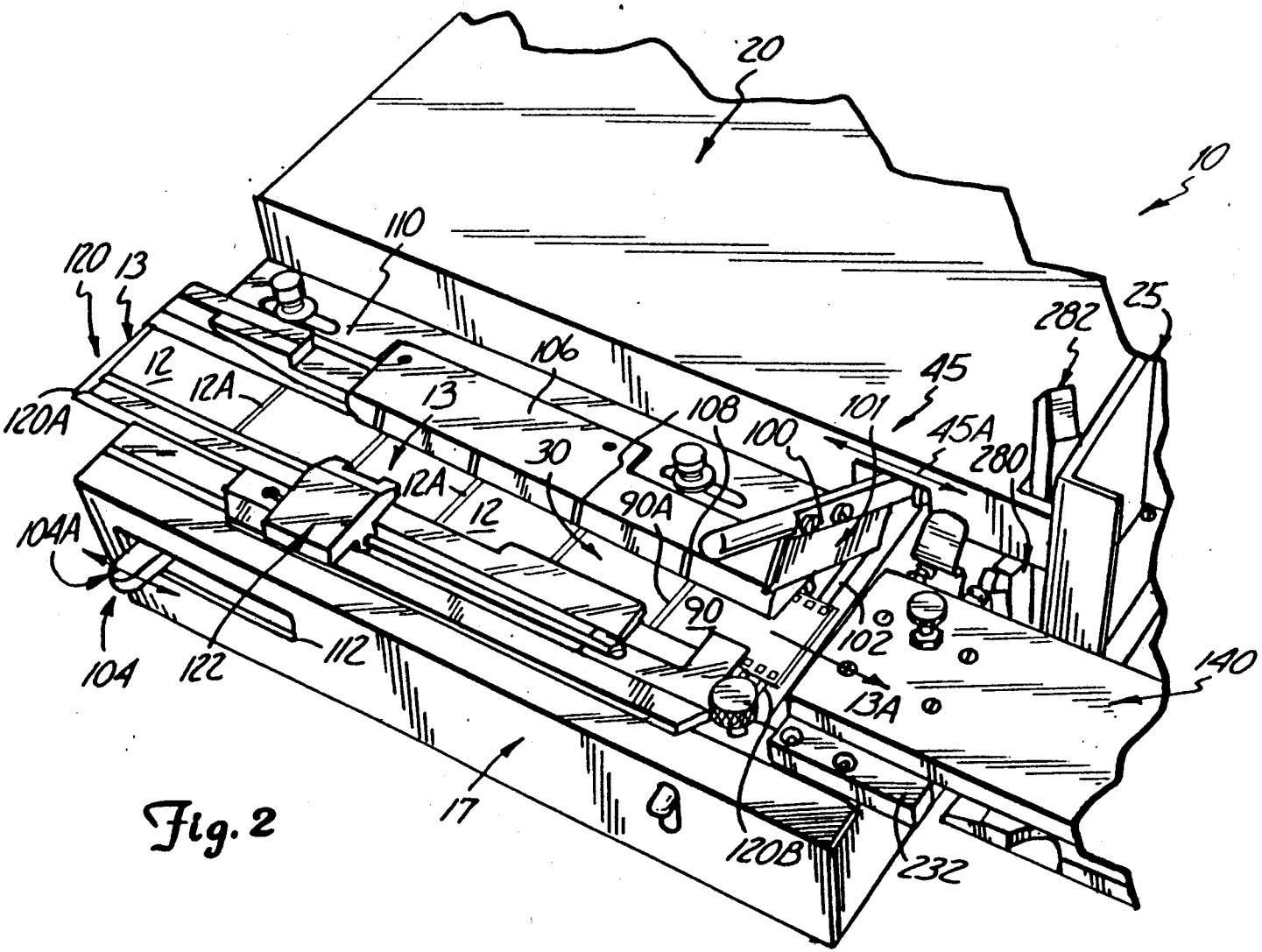
FIG. 2 is a perspective view of a front portion of the slide mounter of the present invention illustrating the movable knife assembly and film web positioned for operation.

(2) Pre-operation Adjustment of the Knife Assembly 45 (FIGS. 2 & 3)

FIGS. 2 and 3 show a detailed perspective view of a front portion of the slide mounter 10 showing the film web 13 supported along the film path 30 aligned with the knife assembly 45. The knife assembly 45 is slidably supported for longitudinal adjustment either towards or away from the supported film as indicated by arrow 45A. Prior to operation, the position of the movable knife assembly 45 is longitudinally adjusted relative to the supported film 13 so that when the film 13 is advanced (arrow 13A) each time for operation, the trailing edge 90A of a leading film transparency 90 will align with upper and lower knife blades 100 and 102 of the movable knife assembly 45.

As shown in FIGS. 2 & 3, the movable knife assembly 45 includes a framing lever 104 and a framing bar 106 aligned with the supported film 13. The framing bar 106 has a plurality of film frame graduations 108. A framing bar support 110 is slidably mounted along (parallel to) the film path 30 and movably supports the framing bar 106 and the upper and lower knife blades 100 and 102. The spacing between each pair of film frame graduations 108 corresponds to the length of a film transparency frame 12. Thus, prior to operation the film frame graduations 108 on the framing bar 106 are aligned with frame delineations 12A of the individual film transparencies 12 so that the trailing edge 90A of the leading film transparency 90 will align with the upper and lower knife blades 100 and 102 when advanced for operation (arrow 13A).

FIG. 2 illustrates an unadjusted position for the framing bar 106 with the film frame graduations 108 of the framing bar 106 out of alignment with the frame delineations 12A of the individual film transparencies 12. FIG. 3 illustrates an adjusted position for the framing bar 106 with the film frame graduations 108 of the framing bar 106 aligned with the frame delineations 12A of the individual film transparencies 12.

The framing lever 104 is operably connected to the framing bar support 110 to move the framing bar support 110 to adjust the position of the framing bar 106 and the upper and lower knife blades 100 and 102. The framing lever 104 extends through a framing lever slot 112 of the frame 17 and is adjusted (arrow 104A) until the film frame graduations 108 of the framing bar 106 align with frame delineations 12A of the individual transparencies 12. As explained, the position of the movable knife assembly 45 is adjusted by the framing lever 104 (until the film frame graduations 108 align with the film transparency delineations 12A) so that when the film 13 is advanced during operation, the trailing edge 90A of the leading film transparency 90 will align with the knife assembly 45.

As shown in FIGS. 2 and 3, the film web 13 is supported along the film path 30 by a movable shuttle bridging mechanism 120. Initially, the film web 13 is loaded onto the shuttle bridging mechanism 120 at end 120A and advanced therealong by a manual film aligner 122. The film 13 is advanced by the manual film aligner 122 to end 120B of the shuttle bridging mechanism 120. This is the position illustrated in FIG. 2. Note that frame delineations 12A are slightly misaligned with frame graduations 108. Thereafter, the framing lever 104 is positioned (arrow 104A) to finely adjust the film frame graduations 108 of the framing bar 106 to align with the frame delineations 12A of the supported film 13, as shown in FIG. 3. The movement of framing bar 106 so that frame graduations 108 align with frame delineations 12A causes knife assembly 45 to be moved longitudinally (arrow 45A) relative to the supported film to the desired location.

Figure 4:
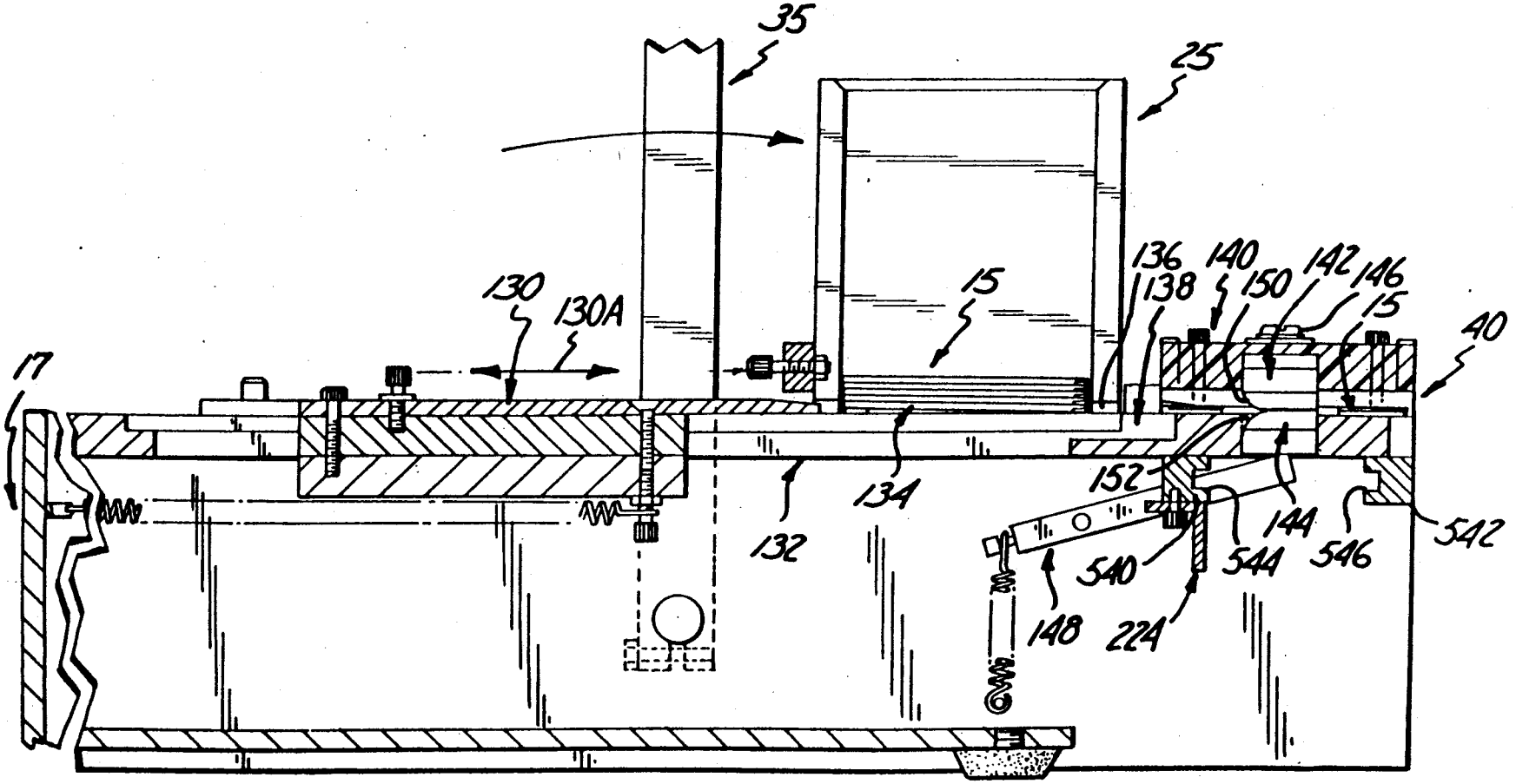
FIG. 4 is a cross-sectional view as taken along line 4—4 of FIG. 1 illustrating a slide ejector for ejecting individual slide mounts from a slide magazine for operation.
Figure 5A:
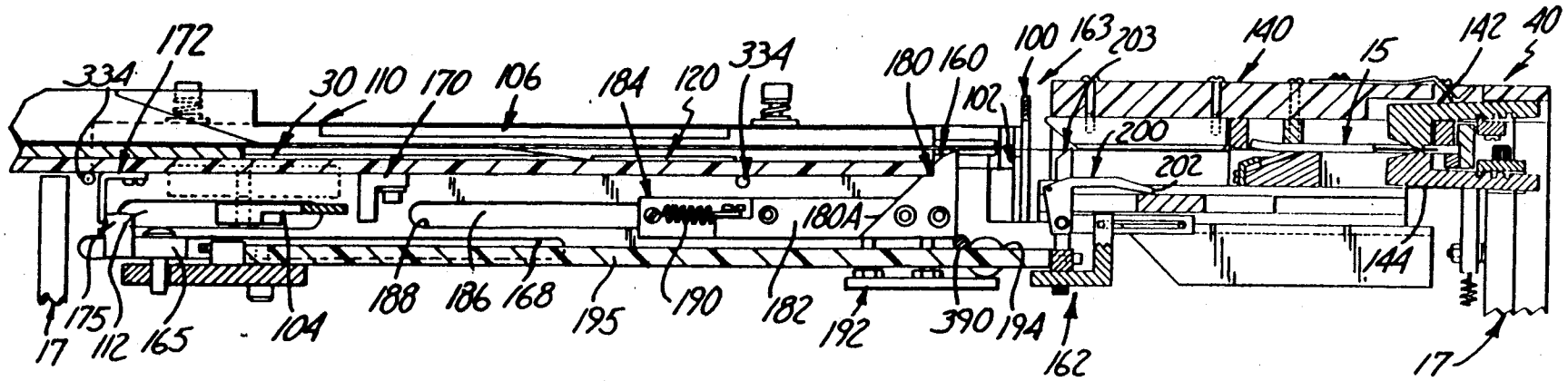
Figure 5B:
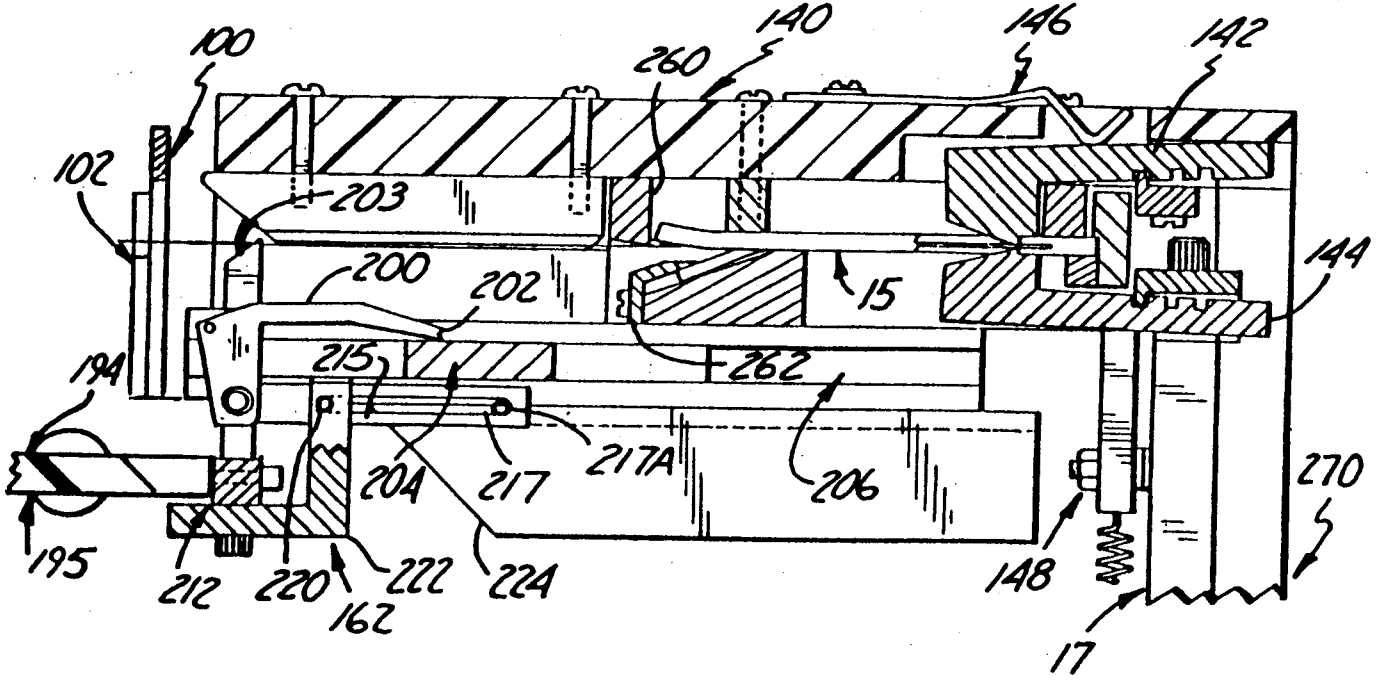

(3) Slide Ejector (FIG. 4)

FIG. 4 is a cross sectional view as taken along line 4—4 of FIG. 1 illustrating a slide ejector 130 for ejecting slide mounts 15 from the slide magazine 25 for operation. The slide ejector 130 moves (arrow 130A) along an ejector track 132 connected to the frame 17, perpendicular to the film path 30. The slide ejector 130 is advanced along the ejector track 132 to force a lowermost slide mount 134 in the slide magazine 25 through a slide mount opening 136 onto a slide track 138 aligned with the insertion station 40. The slide ejector 130 is operably connected to the operating lever 35 and advanced in cooperation therewith. The slide track 138 extends to the insertion station 40 to support the ejected slide mount 15 advanced to the insertion station 40. A lid 140 covers the insertion station 40 during operation as also shown in FIG. 1.

An upper film guide 142 and a lower film guide 144 are included at the insertion station 40 to guide the film 12 into the ejected slide mount 15 at the insertion station 40. The upper and lower film guides 142 and 144 are spring biased together by a leaf spring 146 (upper film guide 142) and a spring biased contact assembly 148 (lower film guide 144). Cooperating curved surfaces 150 and 152 define a receiving opening for the slide mount 15 to force the upper and lower film guides 142 and 144 apart against the spring bias to advance the slide mount 15 past the upper and lower film guides 142 and 144 for placement at the insertion station 40.

Figure 5A:
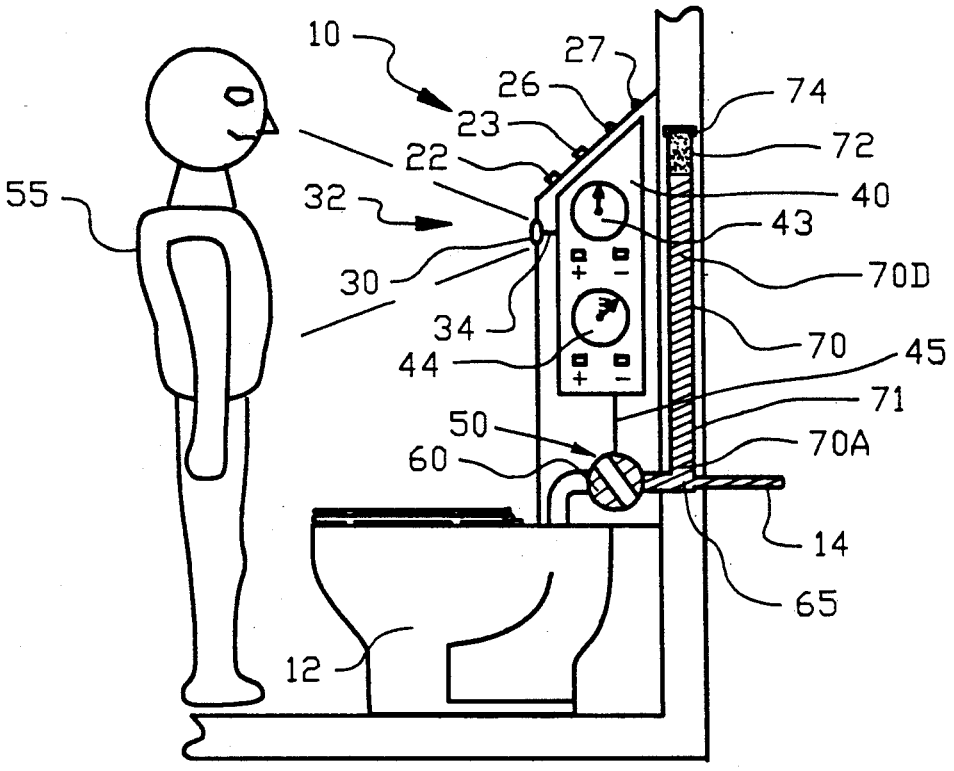
FIGS. 5A and 5B are cross-sectional views as taken along line 5—5 of FIG. 1 illustrating operation of the shuttle bridging mechanism, shuttle film advance, and pusher/finger assembly.
Figure 6A:
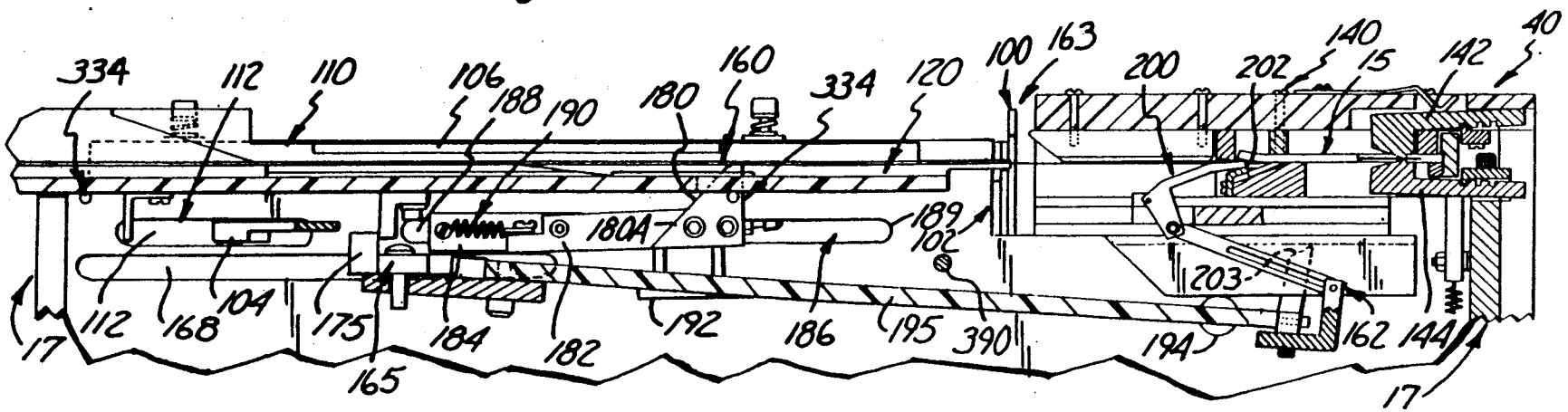
FIGS. 6A and 6B are cross-sectional views, similar to FIGS. 5A and 5B, where the shuttle bridging mechanism, shuttle film advance and the pusher/finger assembly are shown at the completion of the first phase of operation of the motor assembly, with the shuttle bridging mechanism and the pusher/finger assembly advanced and the shuttle film advance retracted.

(4) Shuttle Bridging Mechanism, Shuttle Film Advance and Pusher/Finger Assembly (FIGS. 5A and 6A)

FIGS. 5A and 6A are cross-sectional views taken along line 5—5 of FIG. 1 of the front portion of the slide mounter 10 illustrating the shuttle bridging mechanism 120, a shuttle film advance 160 and a pusher/finger assembly 162 which cooperatively advance the film web 13 along the film path 30 toward the insertion station 40 during operation.

In particular, the shuttle bridging mechanism 120 and the shuttle film advance 160 cooperatively advance the film to align the trailing edge 90A of the leading film transparency 90 with the upper and lower blades 100 and 102 of the knife assembly 45 to sever the leading film transparency 90 from the film web 13 (arrow 13A, FIGS. 2 and 3). Once positioned, the leading film transparency 90 is severed by the knife assembly 45 from the film web 13. Thereafter, the severed film transparency 12 is advanced by the pusher/finger assembly 162 and inserted into a slide mount 15 ejected to the insertion station 40 by the slide ejector 130 (FIG. 4).

FIG. 5A illustrates a pre-operation position of the shuttle bridging mechanism 120, the shuttle film advance 160 and the pusher/finger assembly 162. FIG. 6A illustrates an intermediate position at the completion of a first phase of an operation cycle, with the shuttle bridging mechanism 120 shown advanced across the upper and lower knife blades to support the film thereacross. The operation is cyclical to define a second operation cycle during which the shuttle bridging mechanism 120, the shuttle film advance 160 and the pusher/finger assembly 162 return from the intermediate position to the pre-operation position as shown in FIG. 5A.

During the second phase of operation, the film is supported by the shuttle bridging mechanism 120 (across the upper and lower knife blades 100 and 102) while the shuttle film advance 160 advances the film to align the trailing edge 90A of the leading film transparency 90 with the knife blades 100 and 102. The shuttle film advance 160 operates between a retracted position (FIG. 6A) and an advanced position (FIG. 5A) to align the film (across the knife blades 100 and 102) supported by the shuttle bridging mechanism 120. As shown in FIG. 6A, the pusher/finger assembly 162 is advanced (during the first phase of operation) to insert a film transparency severed during a previous operation cycle into the slide mount 15.

(5) Shuttle Bridging Mechanism (FIGS. 5A and 6A)

Figure 8A:
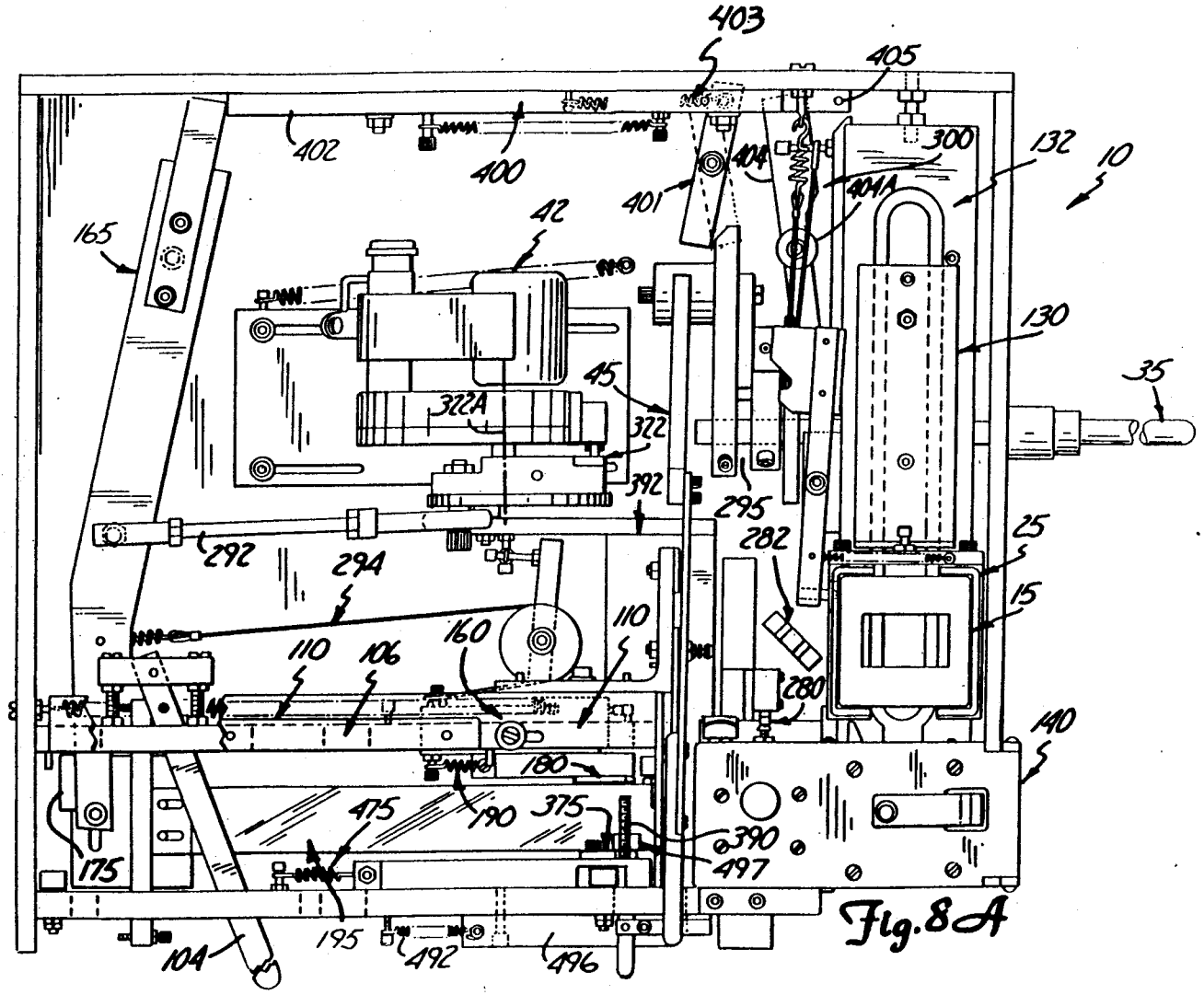
FIG. 8A is a top plan view of the slide mounter of the present invention shown with the cover removed and excluding the pusher/finger assembly and pictured with the shuttle bridging mechanism removed.
Figure 9:
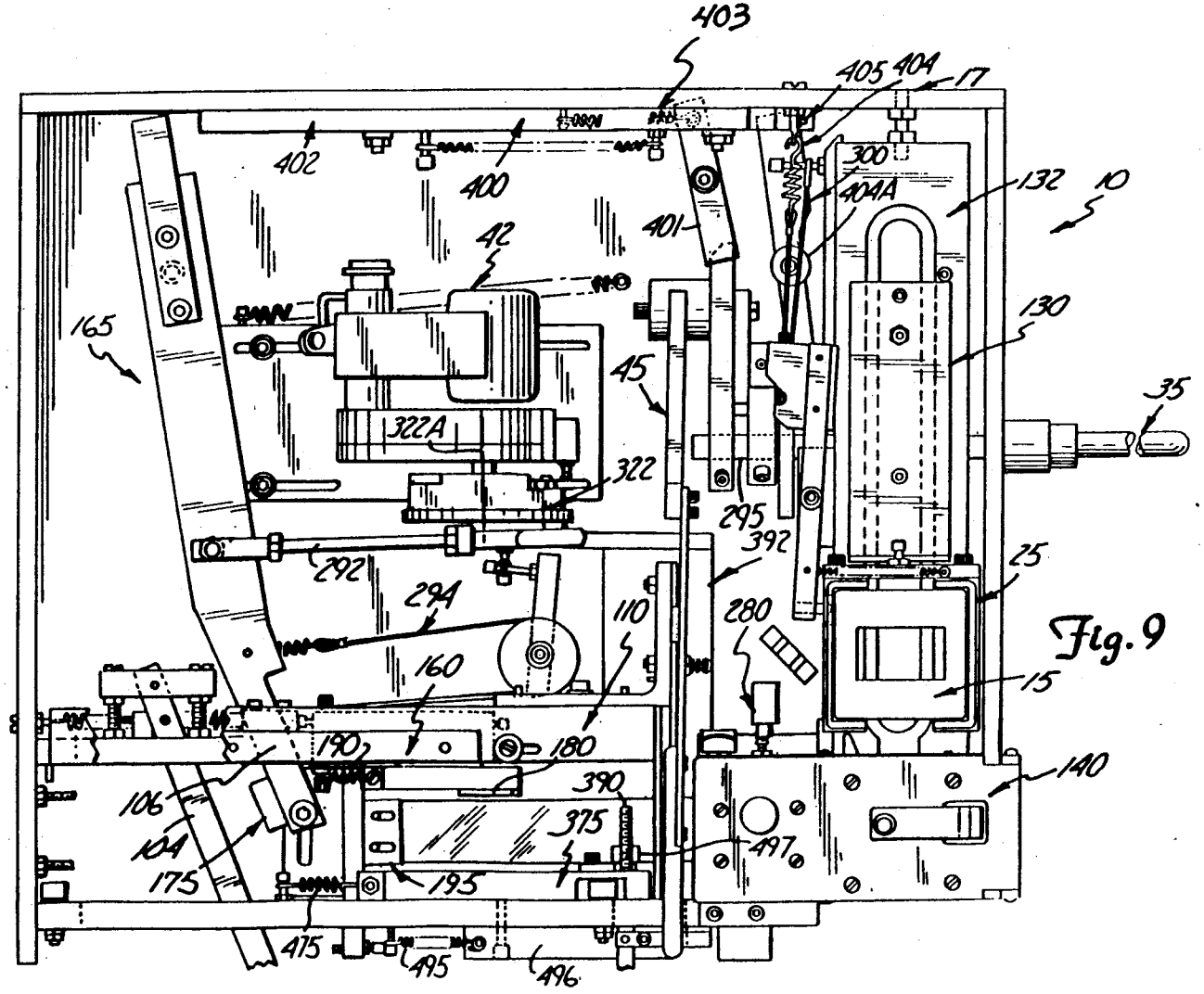
FIG. 9 is a top plan view, similar to FIG. 8, with the drive lever advance at the completion of the first phase of operation of the motor assembly.

As explained more specifically, the shuttle bridging mechanism 120 is advanced toward the knife blades 100 and 102 to bridge a support gap 163 generally defined across the upper and lower knife blades 100 and 102 and across the longitudinal adjustment clearance of the movable knife assembly 45. The shuttle bridging mechanism 120 is advanced along the film path 30 in cooperation with a drive lever 165 pivotally connected to the frame 17 and operably coupled to the motor assembly 42 (FIG. 8A and 9). The shuttle bridging mechanism 120 includes an advancement contact member 170 and a retraction contact member 172. The drive lever 165 extends through an actuator slot 168 and has a shuttle contact member 175 attached to an end thereof in alignment with the advancement contact member 170 and the retraction contact member 172 of the shuttle bridging mechanism 120. Operation of the motor assembly 42 (and accordingly drive lever 165) moves the shuttle contact member 175 to alternately contact the advancement contact member 170 and the retraction contact member 172 of the shuttle bridging mechanism 120 to move the shuttle bridging mechanism 120 back and forth across the upper and lower knife blades 100 and 102 to bridge the support gap 163 thereacross.

The construction and operation of the shuttle bridging mechanism 120 are described in more detail in sections (10) and (14).

(6) Shuttle Film Advance (FIGS. 5A and 6A)

When the shuttle bridging mechanism 120 is in place to bridge the support gap 163 (FIG. 6A), the shuttle film advance 160 advances the film web 13 (during the second phase of operation) so that the trailing edge 90A of the leading film transparency 90 is aligned with the upper and lower knife blades 100 and 102 of the knife assembly 45 as previously described.

The shuttle film advance 160 includes a finger 180, a finger support 182 and a shuttle advance block 184, movable along a shuttle film advance slot 186, generally between a retracted end 188 and an advanced end 189. The finger 180 is supported by the finger support 182 which is connected to the shuttle advance block 184. The finger 180 is designed to engage sprocket holes along the lateral edge of film 13 when advanced in cooperation with shuttle advance block 184.

A helical spring 190 connects the finger support 182 to the shuttle advance block 184 to normally spring bias the finger 180 upward to engage the film 13 supported by the shuttle bridging mechanism 120 (i.e., the film is engaged by the finger 180 during advancement by the shuttle film advance 160 and while the shuttle bridging mechanism 120 is moved from the advanced position to the retracted position). The finger 180 includes a tapered surface 180A in the direction of advancement of the shuttle bridging mechanism 120 to force the finger 180 against the upward spring bias to facilitate movement of the shuttle film advance 160 from the advanced end 189 to the retracted end 188 and to facilitate the advancement of the shuttle bridging mechanism 120. A spring release assembly 192 is mounted to the finger support 182. The spring release assembly 192 facilitates the manual release of the finger 180 of the shuttle film advance 160 as described in detail at the end of section (11).

As shown comparatively in FIGS. 5A & 6A, the shuttle advance block 184 operates between the retracted end 188 of the shuttle advance slot 186 and the advanced end 189. FIG. 5A illustrates the shuttle film advance 160 in a pre-operation position. During the first phase of operation, the finger 180 of the shuttle film advance 160 moves from the advanced end 189 of the slot 186 (FIG. 5A) toward the retracted end 188 (FIG. 6A). Thereafter, during the second phase of operation, the shuttle film advance 160 is advanced from a retracted position as shown in FIG. 6A to return to the pre-operation position shown in FIG. 5A.

As the shuttle film advance 160 is advanced forward from the retracted end 188 toward the advanced end 189 via the shuttle advance block 184, the finger 180 engages the film 13. The distance between the retracted end 188 and the advanced end 189 defines an advancement stroke for the shuttle film advance 160 calculated (when the film frame graduations 108 on the framing bar 106 are aligned with the film frame delineations 12A and the shuttle bridging mechanism 120 is advanced to slightly advance the film web 13) to align the trailing edge 90A of the leading film transparency 12 with the upper and lower knife blades 100 and 102.

The operation and construction of the shuttle film advance 160 are described in more detail in sections (11) and (15).

Figure 5B:
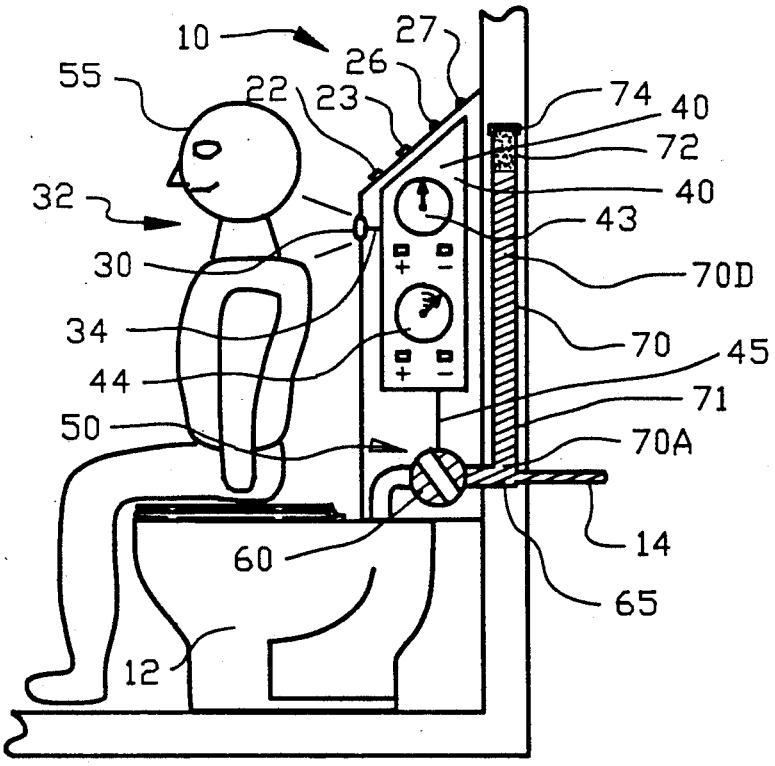
Figure 6B:
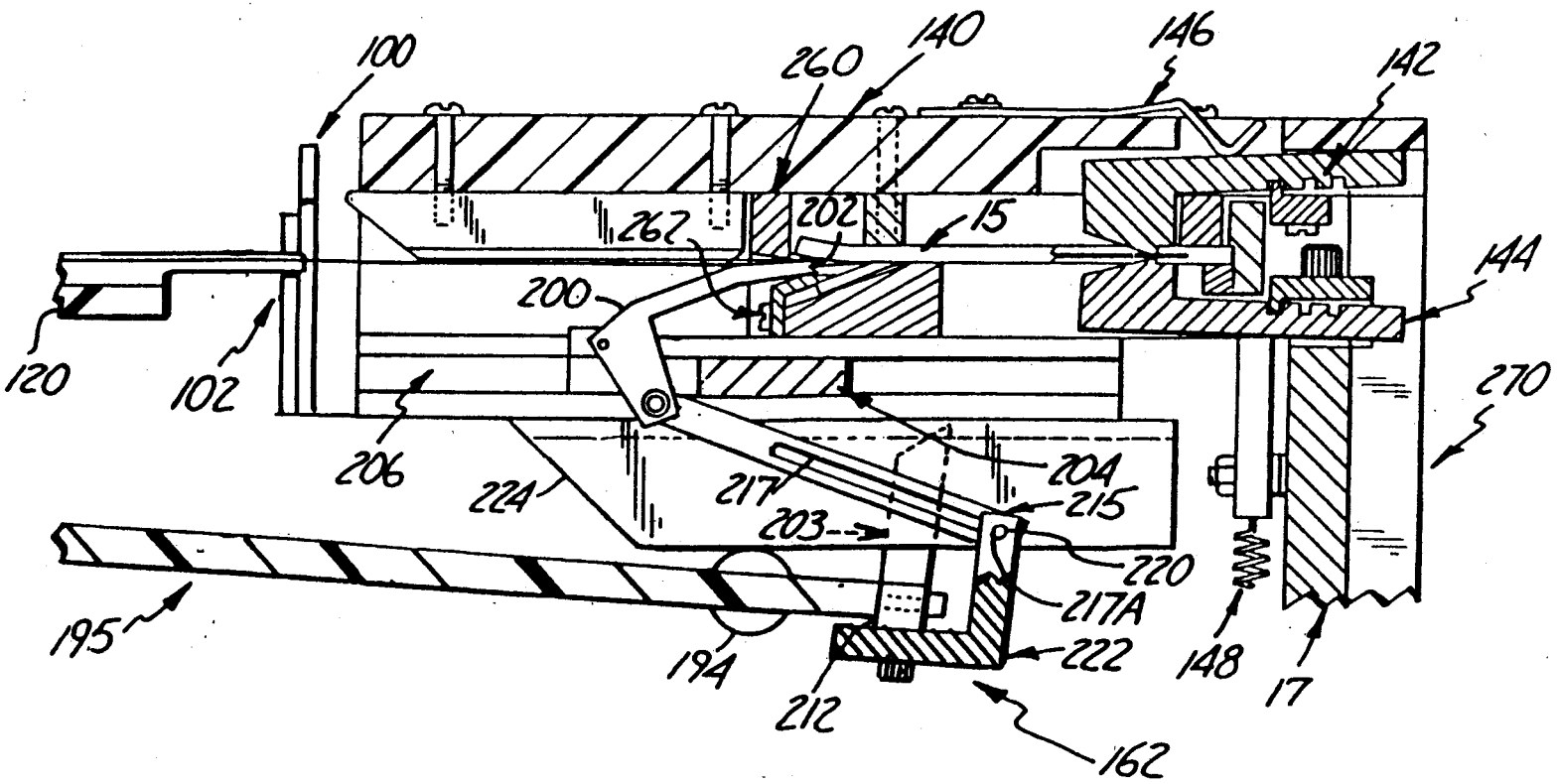

(7) Pusher/Finger Assembly (FIGS. 5B and 6B)

The pusher/finger assembly 162 is operated in cooperation with an actuator 195 attached to the drive lever 165 to insert the film transparency 12 into an ejected slide mount 15 after the film transparency is severed by the knife assembly 45, as progressively illustrated in FIGS. 5A and 6A.

FIGS. 5A and 5B illustrate a retracted position for the pusher/finger assembly 162. FIGS. 6A and 6B illustrate an insertion position for the pusher/finger assembly 162.

The pusher/finger assembly 162 is shown in greater detail in FIGS. 5B and 6B and therefore is described with reference to those two figures.

The pusher/finger assembly 162 includes a pusher 200 having a front grooved surface 202 designed to engage a trailing edge 90A of the severed film transparency 12 and the finger assembly 203. The finger assembly 203 advances the severed film transparency 12 to align the front grooved surface 202 of the pusher 200 with the trailing edge 90A of the severed film transparency 12.

The pusher 200 is pivotally supported by a movable pusher support 204 designed to move along a pusher track 206. The pivotal connection of the pusher 200 to the movable pusher support 206 allows the pusher 200 to operate between a retracted position (below a film plane (FIG. 5B)) and an engaging position (aligned with the film plane (FIG. 6B)) to align the front grooved surface 202 with the trailing edge 90A of a severed film transparency 12.

The finger assembly 203 includes a finger support block 212 which connects the finger assembly 203 to the actuator 195. The finger assembly 203 is advanced by the actuator 195 to align the severed film transparency 12 with the front grooved surface 202 of the pusher 200.

The pusher 200 is connected to a link bar 215 which includes a stroke slot 217. A connecting rod 220 extends through the stroke slot 217. The connecting rod 220 is supported by a connecting rod support 222 which is attached to the finger support block 212 and, in turn attached to the actuator 195 (and the drive lever 165 for operation thereby).

As the actuator 195 advances the finger assembly 203 (to position the pusher 200 with the trailing edge 90A of the severed film transparency 12), the connecting rod 220 advances along the stroke slot 217 toward a contact end 217A (FIG. 6B). As shown in FIG. 6B, the actuator 195 is advanced so that the connecting rod 220 engages the contact end 217A of the stroke slot 217. When the connecting rod 220 engages the contact end 217A, the pusher 200 is rotated to the engaging position to advance the film transparency 12. Thereafter, the link bar 215, via the connecting rod 220, transfers the motion of the actuator 195 to move the pusher 200, to insert the film transparency 12 into the slide mount 15.

A ramped surface 224 is aligned with the actuator 195 (See also FIG. 4). The roller 194 mounted to the actuator 195 interacts with the ramped surface 224 to force the actuator 195 downward, and the finger assembly 203 therewith. The operation of the actuator 195 continues after the roller 194 contacts the ramped surface 224 to advance the pusher 200, via the link bar 215, to insert the severed film transparency 12 into the slide mount 15 in cooperation with the upper and lower film guides 142 and 144.

The construction and operation of the pusher/finger assembly 162 are discussed in more detail later in sections (10) and (17).

As illustrated in FIGS. 5A and 6A, the drive lever 165 advances the shuttle bridging mechanism 120 (FIG. 6A) to support the film 13 across the upper and lower knife blades 100 and 102 (i.e., while the film 13 is advanced by the shuttle film advance 160). At the same time, the actuator 195 operates the pusher/finger assembly 162 via the drive lever 165 to advance the pusher 200 to insert a film transparency severed in a previous operating cycle into an ejected slide mount 15 at the insertion station 40.

Figure 7:
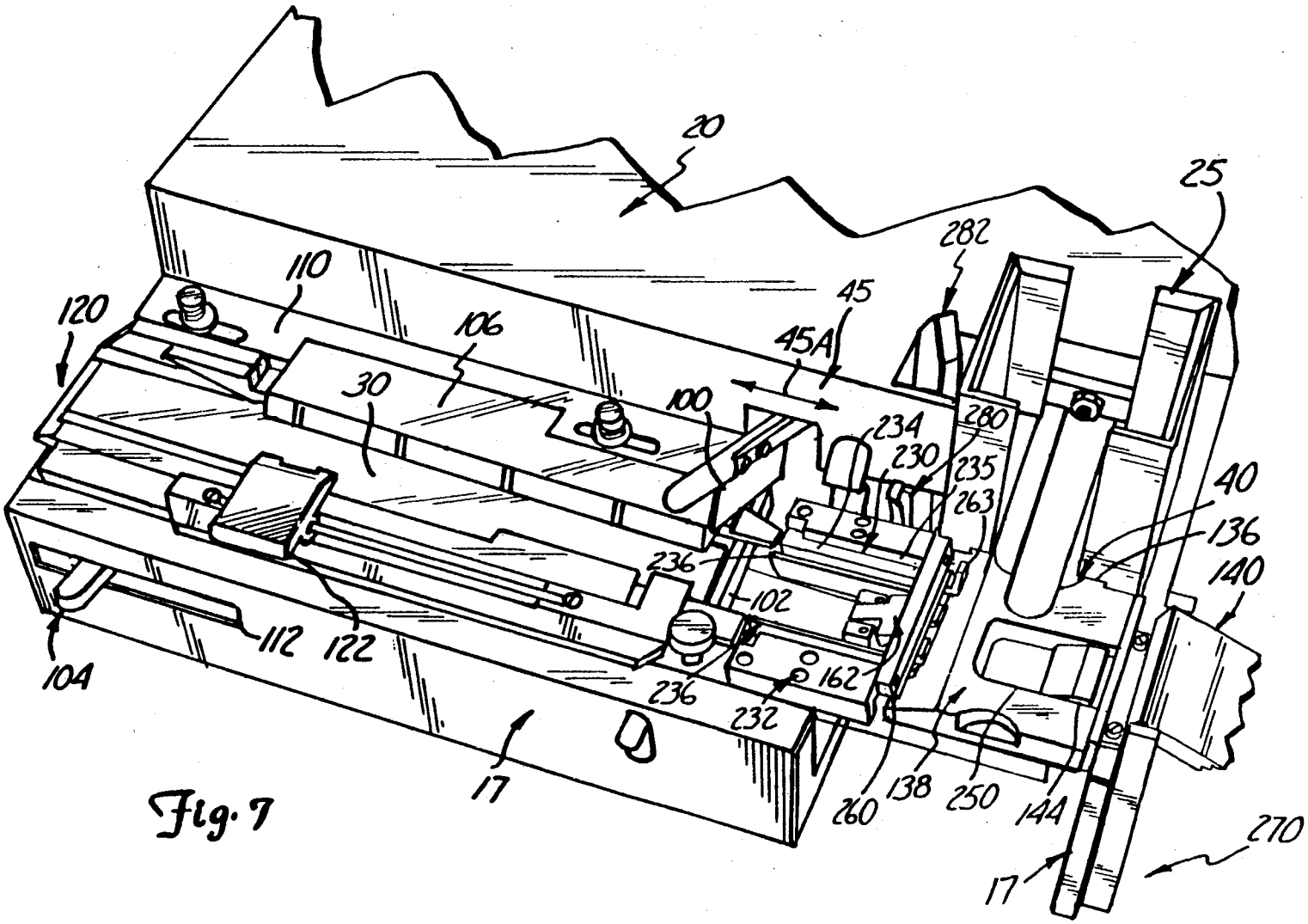
FIG. 7 is a perspective view of the front portion of the slide mounter illustrating the shuttle bridging mechanism advanced for operation.

FIG. 7 is a perspective view of the front portion of the slide mounter 10, similar to FIGS. 2 and 3, with the lid 140 opened (the lid 140 is closed in FIGS. 1, 2 and 3) to expose the first and second film receiving supports 230 and 232 and the pusher/finger assembly 162 (shown in the advanced position). The first and second film receiving supports 230 and 232 support the film 13 on the opposite side of the upper and lower blades 100 and 102 from the extent of the shuttle bridging mechanism 120, while the film is severed and advanced into a slide mount 15 by the pusher/finger assembly 162. The film receiving supports 230 and 232 each include a support ledge 234 and a guide edge 235. Parallel supports 236 are aligned with and spaced from each support ledge 234 to cooperatively support the severed film transparency 12 along each lateral edge thereof.

As shown in FIG. 7, the insertion station 40 is defined by the slide track 138 having an aperture window 250, an upper retaining ledge 260, a lower retaining ledge 262 (not visible in FIG. 7, see FIGS. 5B and 6B) and a slide mount frame separator 263. As a slide mount 15 is ejected from the slide magazine 25 to the insertion station 40 by the slide ejector 130 (FIG. 4), the slide mount separator 263 opens the slide mount 15 which is held open during operation by the upper and lower retaining ledges 260 and 262 to receive a severed film transparency 12 inserted by the pusher/finger assembly 162 (FIGS. 5B and 6B). The lower film guide 144 is supported by the frame 17 and extends through aperture window 250. The lid 140 supports the upper film guide 142 (FIGS. 4, 5A, 6A). As explained, the upper and lower film guides 142 and 144 guide the film into the opened slide mount 15 at the insertion station 40 as it is advanced by the pusher/finger assembly 162.

Also, as shown in FIG. 7, a lid support 270 is connected to the frame 17 to pivotally support the lid 140 to adjust between the closed position (lid 140 parallel to insertion station 40 (FIGS. 1-3 and 5A-6B), and a "flipped back," opened position (FIG. 7). A contact switch 280 is operably connected to the motor assembly 42 to restrict operation of the motor assembly when the lid 140 is in the "flipped back" opened position (FIG. 7) and the upper film guide 142 is not in place. Thus, when the lid 140 contacts the switch assembly 280 in the closed position (FIGS. 1-3 and 5A-6B), the operation of the motor assembly 42 is enabled and when the lid 140 is "flipped back" in the opened position (FIG. 7), the switch assembly 280 is opened to inhibit operation of the motor assembly 42. A slide mount extension support 282 is included to support a slide magazine extension (not shown) to store more slide mounts for operation.

FIGS. 8A and 9 are overall plan views of the slide mounter 10 with the cover removed and the shuttle bridging mechanism 120 removed for illustration and the lid 140 in the closed position to cover the insertion station 40 so that the pusher/finger assembly 162 is not visible. FIGS. 8A and 9 progressively illustrate operation of the shuttle bridging mechanism 120 (not shown), the shuttle film advance 160 and the pusher/finger assembly 162 (not shown) by the motor assembly 42.

The shuttle bridging mechanism 120 (not shown), the shuttle film advance 160 and the pusher/finger assembly 162 (not shown) are operated in cooperation with the motor assembly 42 via the drive lever 165 which is operably connected to the motor assembly 42 via a drive rod 292. The motor assembly 42 rotates the drive rod 292 to move the drive lever 165 from a rest position as shown in FIG. 8A to a forward position as shown in FIG. 9.

As explained, the drive lever 165 operates the shuttle contact member 175 attached thereto to reciprocally move the shuttle bridging mechanism 120 and moves the actuator 195 (attached thereto) to operate the pusher/finger assembly 162. As illustrated a pulley assembly 294 is operably connected to the drive lever 165 and the shuttle film advance 160 to reciprocally operate the shuttle film advance 160. FIG. 8A shows the pulley assembly 294 forcing the shuttle film advance 160 toward the advanced position (advanced position of the shuttle film advance 160 shown in FIG. 5A). FIG. 9 shows the pulley assembly 294 positioning the shuttle film advance 160 toward a retracted end to "pick up" the film 13 for advancement (retracted position for the shuttle film advance 160 shown in FIG. 6A).

The operation of the shuttle bridging mechanism 120 and the pusher/finger assembly 162 is detailed in section (10). The operation of the shuttle film advance is detailed in section (11).

As shown at the right hand side of FIGS. 8A and 9, the operation of the knife assembly 45 and the slide ejector 130 is controlled by the operating lever 35 via a drive shaft 295 as further detailed in sections (8) and (9) to follow.

Figure 8B:
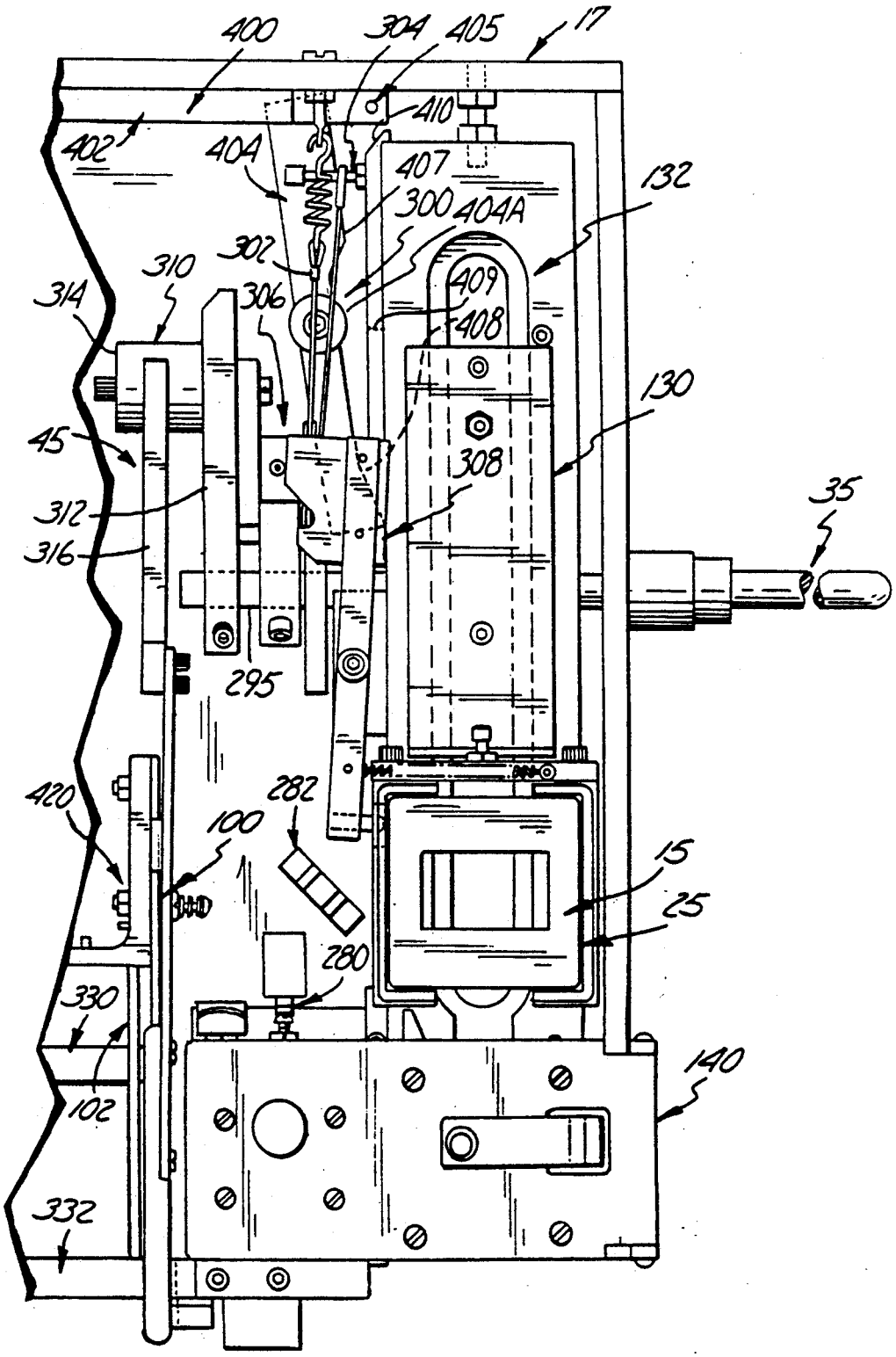
FIG. 8B is a detailed top plan view of the right hand portion of the slide mounter as shown in FIG. 8A illustrating the construction and operation of the slide ejector and knife assembly.

(8) Operation of the Slide Ejector (FIG. 8B)

As shown in FIG. 8B, the slide ejector 130 is advanced along the ejector track 132 in cooperation with a pulley assembly 300 linked to the drive shaft 295. The pulley assembly 300 includes a pulley cable 302 connected to the frame 17 at one end and connected to a connecting pin 304 attached to the slide ejector 130, at the other end. The pulley cable 302 end connected to pin 304 of the slide ejector 130 is advanced forward via a pulley drive 306 coupled to the drive shaft 295. The pulley drive 306 advances the pulley cable 302 at the end connected to the connecting pin 304 to advance the slide ejector 130 along the ejector track 132. The other end of the cable 302 connected to the frame 17 does not advance. The slide ejector 130 further includes an inhibitor mechanism 308 for restricting operation of the slide mounter 10 when the number of slide mounts 15 stacked in the slide magazine 25 becomes small.

A more detailed description of operation of the slide ejector 130 is described in the previously-mentioned copending application entitled "Slide Mounter with Improved Slide Mount Advance" (Ser. No. 822,988, filed on Jan. 15, 1992.

Figure 10:
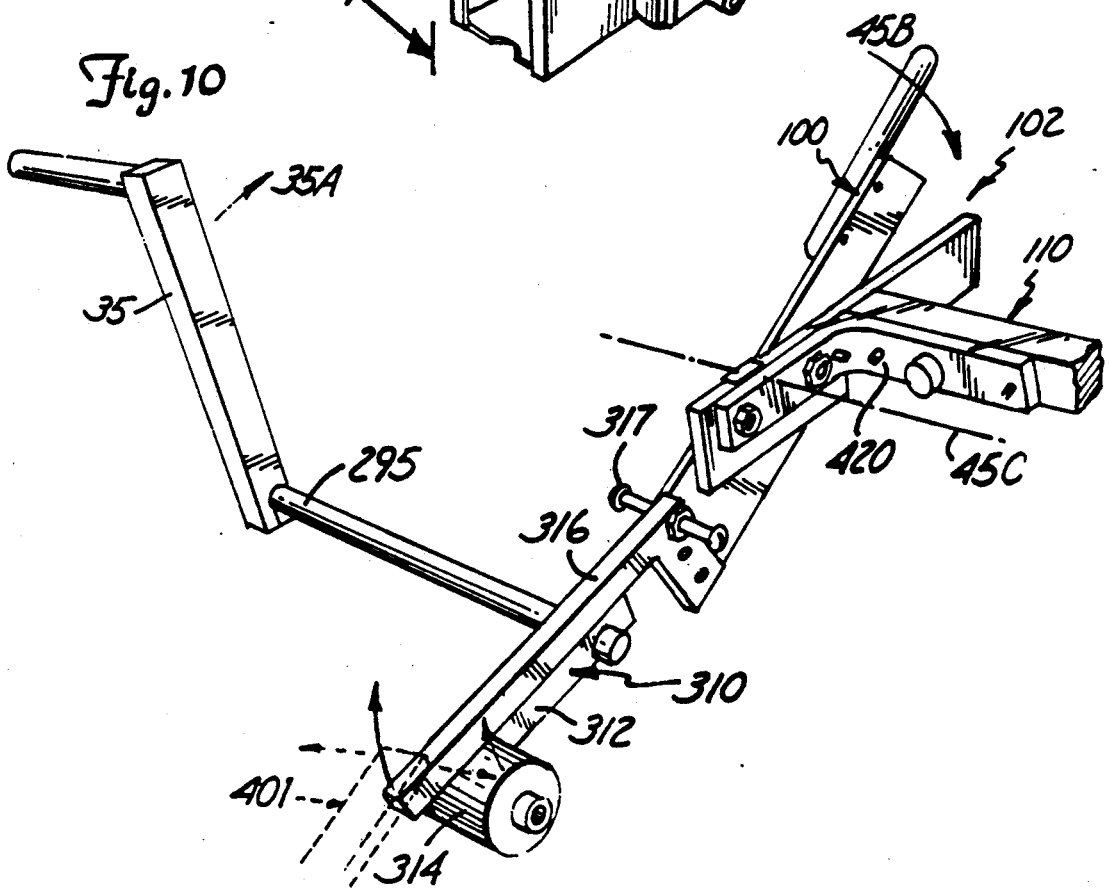
FIG. 10 is a perspective view of the operation of the knife assembly of the slide mounter.

(9) Operation of the Knife Assembly (FIGS. 8B and 10)

As shown in FIGS. 8B and 10, the upper knife blade 100 is pivotally connected to the lower knife blade 102 to pivot relative to the lower knife blade 102 between an opened receiving position and a closed cutting position. As shown more clearly in FIG. 10, a knife actuating assembly 310 is connected to the drive shaft 295 and includes a lever arm 312 and a contact extension 314. The upper knife blade 100 is rigidly fixed to a knife extension 316, the knife extension 316 includes pins 317 (FIG. 10) to spring bias the upper blade 100 in the opened position. The lever arm 312 of the knife actuating assembly 310 is rotated by the drive shaft 295 to move the contact extension 314 upward to engage the knife extension 316 to pivot the upper knife blade 100 about axis 45C (FIG. 10, arrow 45B) to force the upper blade 100 toward the lower blade 102 to close the knife blades 100 and 102 to sever the film transparency 12 positioned thereacross.

The contact extension 314 is sufficiently wide to assure that the extension 314 will contact the knife extension 316 if the position of the knife assembly 45 is longitudinally adjusted by the framing lever 104 (as illustrated in FIGS. 2 and 3).

As explained, the operating lever 35 is advanced forward (arrow 35A) to operate the knife assembly 45 and advance the slide ejector 130 along the ejector track 132 to eject a slide mount 15, and then is released.

When the operating lever 35 is released, the slide ejector 130 is released from a forward ejection position (not shown) to contact a start switch. The start switch commences operation of the motor assembly 42. As previously explained, the motor assembly 42 operates the shuttle bridging mechanism 120, the shuttle film advance 160 and the pusher/finger assembly 162. Actuation of the start switch is described in further detail in section (12).

Figure 8C:
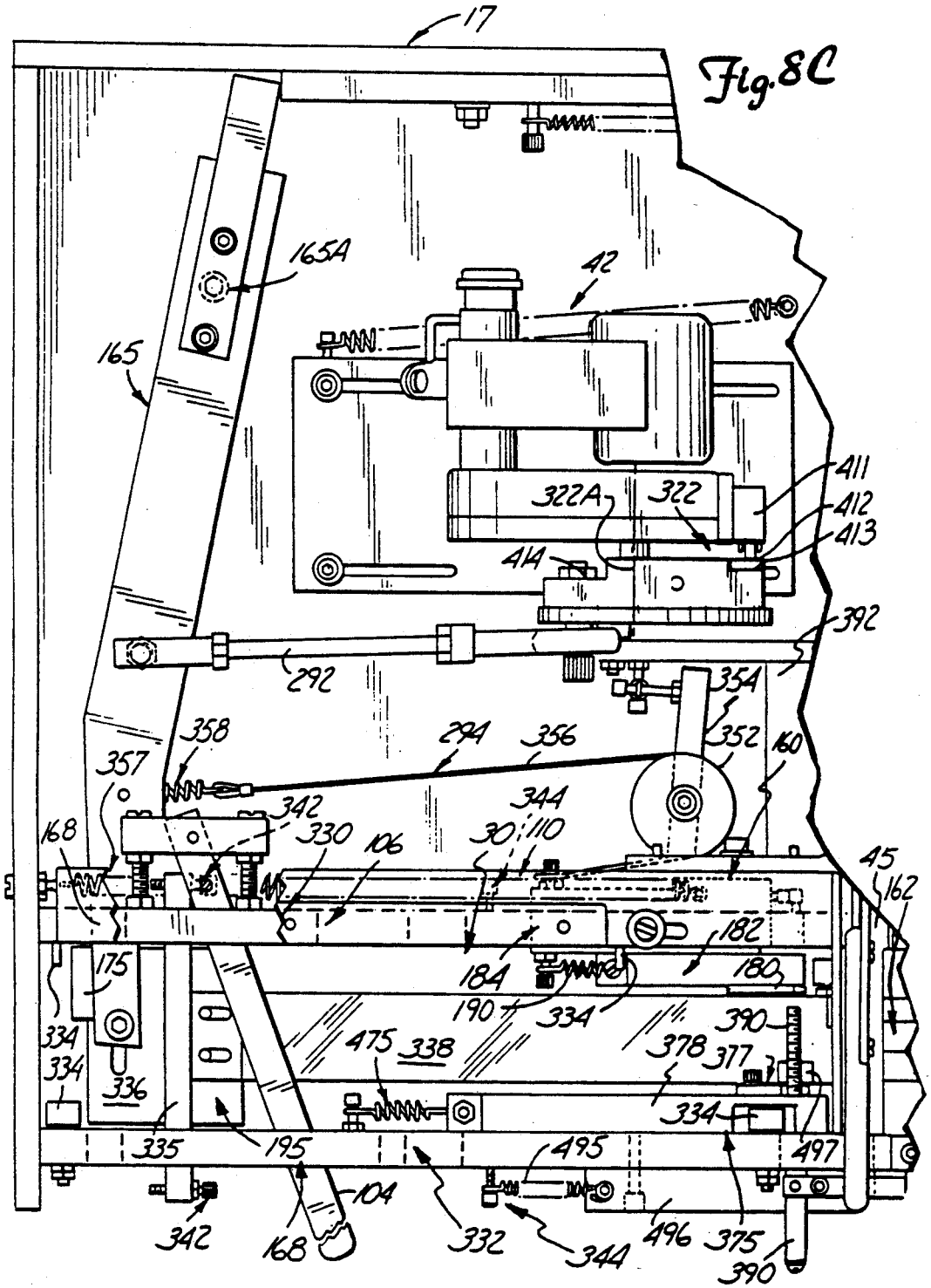
FIG. 8C is a detailed top plan view of the left hand portion of the slide mounter as shown in FIG. 8A illustrating operation and construction of the motor assembly operating the shuttle bridging mechanism, the shuttle film advance, and the pusher/finger assembly.

(10) Operation of the Pusher/Finger Assembly and the Shuttle Bridging Mechanism (FIGS. 8C and 9)

FIG. 8C shows the left hand portion of the overall plan view of FIG. 8A. The operation of the pusher/finger assembly and the shuttle bridging mechanism by the drive lever 165 is described with reference to FIGS. 8C and 9.

As shown in FIGS. 8C and 9, the motor assembly 42 is slidably mounted relative to the frame 17 to move the drive lever 165 pivotally connected to the frame 17. In particular, the motor assembly 42 rotates a crank arm 322 which is operably connected to the drive lever 165 via the drive rod 292. The drive rod 165 transfers the rotational motion of the crank arm 322 (about axis 322A) to linearly move the drive lever 165 about the pivot (165A).

The crank arm 322 rotates a complete revolution (360 degrees) about axis 322A to define the first operation phase (the first half of the revolution) and the second operation phase (the second half of the revolution) of the slide mounter 10. During the first operation phase, the drive lever 165 is advanced from the rest position (shown in FIGS. 8A and 8C) toward the insertion station 40 to a forward position (FIG. 9) and during the second phase of the operation, the drive lever 165 is retracted from the forward position (FIG. 9) toward the rest position (FIGS. 8A and 8C). FIGS. 8A and 8C illustrate the drive lever 165 in the rest position, FIG. 9 illustrates the drive lever 165 in the forward position.

The film path 30 is defined by a first track support 330 and a second track support 332, parallel to the first track support 330 but spaced therefrom. The first and second track supports 330 and 332 include bridging supports 334 (FIG. 8C).

The shuttle bridging mechanism 120 is movably supported between the first and second track supports 330 and 332 on top of the bridging supports 334 to support the film 13 thereupon. As previously explained, the shuttle bridging mechanism 120 is movably operated along the film path 30 by the drive lever 165. The drive lever 165 extends through the actuator slot 168 (FIGS. 5A and 6A) of the first track support 330 to align the shuttle contact member 175 (mounted at the end thereof) with the advancement contact member 170 and the retraction contact member 172 of the shuttle bridging mechanism 120.

The pusher/finger assembly 162 is operated by the actuator 195 operably connected to the drive lever 165. The actuator 195 is movably supported between the first and second track supports 330 and 332. The actuator 195 includes a cross bar support 335, mounting plate 336 and a pusher support extension 338 (FIG. 8C). The cross bar support 335 and the pusher support extension 338 are connected to the mounting plate 336. The cross bar support 335 extends through cooperating actuator slots 168 (See also FIG. 11) through each track support 330 and 332. The drive lever 165 extends through the actuator slot 168 of the first track support 330 and connects to the mounting plate 336 of the actuator 195. The pusher/finger assembly 162 is operably connected to the actuator 195 at a forward end of the pusher support extension 338. Movement of the drive lever 165, therefore, moves the actuator 195 along the first and second track supports 330 and 332 to thereby operate the pusher/finger assembly 162.

The actuator 195 includes actuator contact members 342 which are designed to engage corresponding stop contact members 34 mounted to the track supports 330 and 332 to define a stroke for the actuator 195 and the drive lever 165 (operating the actuator 195). Thus, the actuator contact members 342 and the stop contact members 344 cooperate to define an insertion position for the pusher assembly 200 (operably coupled with the actuator 195 and movable thereby). Further, the extent between the actuator contact members 342 and the stop contact members 344 also defines a stroke for shuttle contact member 175 attached to the drive lever 165 for moving the shuttle bridging mechanism 120.

As explained, during the first phase of operation of the motor assembly 42, the drive lever 165 advances from the rest position (FIG. 8C) toward the forward position (FIG. 9). The drive lever 165 moves from the rest position to the forward position to advance the shuttle contact member 175 to move the shuttle bridging mechanism 120 slidably supported thereabove to bridge the support gap 163 (including the longitudinal adjustment clearance of the movably knife assembly 45) across the knife assembly 45 as shown comparatively in FIGS. 5A and 6A.

At the same time, namely, during the first phase of operation, the pusher/finger assembly 162, (shown in detail in FIGS. 5B and 6B) is also advanced as the drive lever 165 moves from the rest position to the forward position. In particular, the actuator 195 is advanced along the first and second track supports 330 and 332 by the drive lever 165 as shown comparatively in FIGS. 5A and 6A. Since the pusher/finger assembly 162 is mounted at the forward end of the support extension 338 of the actuator 195, the drive lever 165 advances the pusher/finger assembly 162. The pusher/finger assembly 162 advances from a retracted position shown in FIG. 5B to the insertion position as shown in FIG. 6B to insert a severed film transparency (advanced during a prior operation cycle by the shuttle bridging mechanism 120 and the shuttle film advance 160 and severed with the ejection of the slide mount 15 by operation of the operating lever 35) into a slide mount 15 at the insertion station 40.

During the second phase of operation, the drive lever 165 is withdrawn from the forward position as shown in FIG. 9 toward the rest position FIG. 8C to withdraw the shuttle bridging mechanism 120 and the pusher/finger assembly 162 from the advanced insertion position (FIG. 6A) to the retracted position (FIG. 5A). More particularly, as the drive lever 165 is withdrawn, the shuttle contact member 175 engages the retraction contact member 172 of the shuttle bridging mechanism 120 to withdraw the shuttle bridging mechanism 120 from across the upper and lower blades 100 and 102 of the knife assembly 45 (to the pre-operation position) to permit operation of the knife assembly 45 (FIG. 5A). The retraction contact member 172 is positioned so that the shuttle contact member 175 contacts the retraction contact member 172 towards the end of the second operation phase so that the shuttle bridging mechanism 120 is in place to guide the film 13 advanced by the shuttle film advance 160 during the second phase of operation of the motor assembly 42. As the drive lever 165 is withdrawn so too is the actuator 195 to retract the pusher/finger assembly 162 for the next operation cycle.

(11) Operation of the Shuttle Film Advance (FIG. 8C and 9)

As previously explained, the shuttle file advance 160 reciprocally moves between an advanced position shown in FIG. 5A to a retracted position shown in FIG. 6A to advance the film supported by the shuttle bridging mechanism 120 to align the film with the knife blades 100 and 102.

The shuttle film advance 160 is operated between the advanced position and the retracted position in cooperation with the drive lever 165 and the pulley assembly 294 (FIGS. 8C and 9). The pulley assembly 294 includes a pulley 352, supported by a pulley support block 354 mounted to frame 17, a pulley cable 356 and a retraction spring 357 (FIG. 8C). The pulley cable 356 is connected at a first end to the shuttle film advance 160 and at the other end tot he drive lever 165 by an override spring 358. The retraction spring 357 connects the shuttle film advance 160 to the frame 17 to bias the shuttle film advance 160 in the retracted position as shown in FIGS. 6A and 9.

Prior to operation of the motor assembly 42, the drive lever 165 is in the rest position (FIG. 8C) to force the shuttle film advance 160 toward the advanced position by operation of the pulley assembly 294 coupled to the drive lever 165. During the first phase of operation of the motor assembly 42, the drive lever 165 is advanced forward (i.e., during the first phase of operation, the lever 165 moves from the rest position (FIG. 8C) to the forward position (FIG. 9)), thereby releasing the tension applied tot he pulley cable 356. Without the tension applied to the pulley cable 356 by the drive lever 165, the tension of the retraction spring 357 is sufficient to force the shuttle film advance 160 toward the retracted position shown in FIGS. 6A and 9. At this time, the shuttle bridging mechanism 120 is advanced by the drive lever 165 to bridge the support gap 63.

During the second phase of operation of the motor assembly 42, the drive lever 165 is retracted from the forward position FIG. 9 to the rest position FIG. 8C. As the drive lever 165 is retracted toward the rest position FIG. 8C, the drive lever 165 again applies tension to the pulley cable 356 to force the shuttle film advance 160 forward as shown in FIGS. 5A and 8C toward the advanced position. That is, the force applied to the shuttle film advance 160 via the pulley cable 356 is sufficiently greater than that applied by the retraction spring 357 causing the shuttle film advance 160 to move forward toward the advanced end 189 of the shuttle advance slot 186 (FIG. 5A). As the shuttle film advance 160 moves from the retracted position toward the advanced position, the shuttle film advance 160 advances the finger 180 (which engages the film through the sprocket holes along the lateral edge of the film) to move the supported film forward across the upper and lower knife blades 100 and 102. Thus, as described, the pulley assembly 294 and the retraction spring 357 reciprocally operate the shuttle film advance 160 between the advanced position and the retracted position.

As shown in FIG. 8C a fixed finger assembly 375 is mounted to the second track support 332 to maintain the position of the advanced film 13 across the upper and lower knife blades 100 and 102 while the shuttle bridging mechanism 120 is retracted to operate the knife assembly 45. The fixed finger assembly 375 also maintains the position of the film 13 while the shuttle film advance 160 is retracted and while the shuttle bridging mechanism 120 advances. The fixed finger assembly 375 includes a finger 377, a finger support 378 and a position control lever 390. The finger 377 of the fixed finger assembly 375 is normally biased upward to engage the film through sprocket holes thereof.

While the film 13 is advanced across the upper and lower blades 100 and 102 of the knife assembly 45, a fixed finger control assembly 392 operably connected to the crank arm 322 cooperates with the position control lever 390 (which is coupled with the fixed finger support 378) to force the fixed finger 375 out of alignment with the advancing film 13. When the film 13 is in place across the upper and lower knife blades 100 and 102, the fixed finger control assembly 392 releases the position control lever 390 to force the fixed finger 375 upward (with the spring bias) to engage the film 13 to maintain the position of the film while the shuttle bridging mechanism 120 is retracted to operate the knife blades 100 and 102. The operation and function of the fixed finger assembly 375 is described in more detail in section (16).

It should be noted that the position control lever 390 of the fixed finger assembly 375 is accessible to the user and may be operated manually rather than operated in cooperation with crack arm 322 of the motorized drive 42. The position control lever 390 can be manually depressed to simultaneously release both the fixed finger 377 and the finger 180 of the shuttle film advance 160 to remove the film 13 supported by the shuttle bridging mechanism 120. As shown in FIGS. 8A and 9, the position control lever 390 extends between the first and second track supports 330 and 332 above the actuator 195 (in particular pusher support extension 338). The extended end of the position control lever 390 is aligned with the forward end of the actuator 195 (pusher support extension 338) to force the actuator 195 downwards when the position control lever 390 is manually depressed. In FIG. 5A, when the position control lever 390 is manually depressed to contact the actuator 195 (pusher support extension 338), the roller 194 (mounted at the forward end of the actuator 195) engages the spring release assembly 192 of the shuttle film advance 160 to lower the finger 180 against the upward spring bias (spring 190) to release the finger 180 of the shuttle film advance 160 from the film. The control lever 390, which is coupled to the finger support 378 simultaneously releases the finger 377 of the fixed finger assembly 375.

As shown in FIGS. 8A and 9, while the motor assembly 42 operates, the operation of the operating lever 35 is locked by a latch assembly 400. As shown in FIGS. 8A and 9, the latch assembly 400 includes a latch arm 401 and a latch operator 402. The latch operator 402 moves the latch arm 401 from an unlatched position (shown in FIG. 8A) to a latched position (shown in FIG. 9) to restrict operation of the operating lever 35. The latch arm 401 is normally spring biased in the latched position by a spring 403. The latch operator 402 is controlled by the drive lever 65 to move the latch operator 402 to force the latch arm 401 from the normally latched position to the unlatched position while the drive lever 165 is in a non-operational rest position (FIG. 8A).

(12) Operation of the Motor Assembly (FIGS. 8A, 8B, 8C and 9)

As previously explained, the operation of the motor assembly 42 is initiated by a start switch mounted to a pivot start contact support 404 operably coupled with the release of the slide ejector 130. In particular as shown in FIG. 8B, the pivot start contact support 404 is an elongated rectangular member which has a central pivotal connection 404A to the frame 17. The elongated member extends from the central pivot connection 404A so that a first end thereof is in alignment with a contact pin 405 mounted to a lower surface of the latch operator 402. The pivot start contact support 404 includes a central recess to define first and second raised edges 407 and 408. The second raised edge 408 is aligned (in a pre-operation position shown in FIGS. 8A and 9) with a forward contact surface 409 of the slide ejector 130 such that when the slide ejector 130 is advanced forward for ejection of a slide mount 15 (forward position not shown) along the ejector track 132, the forward contact surface 409 of the slide ejector 130 engages the second raised edge 408 to rotate the pivot start contact support 404 clockwise.

The start switch is supported at the first raised edge 407 of the pivot start contact support 404 which accordingly rotates to an engaging position (not shown) upon contact of the forward contact surface 409 of the slide ejector 130 with the second raised edge 408. In the engaging position, the contact switch is in alignment with a release contact surface 410 of the slide ejector 130. After the slide ejector 130 ejects a slide mount 15 to the insertion station 40 and is released, the release contact surface 410 of the slide ejector 130 contacts the switch supported in the engaging position (not shown) to initiate operation of the motor assembly 42.

When the release contact surface 410 of the slide ejector 130 engages the start switch, the operation of the motor assembly 42 commences. The motor assembly 42 moves the drive lever 165 via the drive rod 292. As previously explained, in the pre-operation position the drive lever 165 contacts the latch operator 402 to force the latch operator 402 against the spring bias to the unlatched position (FIG. 8A). During operation of the motor assembly 42, the drive lever 165 releases the latch operator 402 against the spring bias to the latched position (FIG. 9). As the latch operator moves from the unlatched position (FIG. 8A) to the latched position (FIG. 9), the contact pin 405 mounted thereon contacts the first end of the pivot start contact support 404 to rotate the pivot start contact support 404 counterclockwise to move the first end (first raised edge 407) from the engaging position to permit the slide ejector 130 to move past to eject a slide mount during the next operation cycle.

During an operation cycle of the slide mounter 10, the crank arm 332 rotates a complete revolution (360°) to operate the shuttle bridging mechanism 120, the pusher/finger assembly 162 and the shuttle film advance 160 to prepare a photographic slide. A stop switch stops the motor assembly 42 after the crank arm 332 completes a revolution. As shown in FIG. 8C, the stop switch 411 is mounted to the motor assembly 42 in alignment with one side of the crank arm 322 (FIG. 8C). The crank arm 322 includes first and second ends.

The first end of said side of crank arm 322 is stepped to define a contact surface 412 and a recessed groove 413 into which the stop switch 411 extends in a pre-operation (not contacted) position (FIG. 8C). The second end of said side includes a cutout edge 414 such that during the clockwise rotation of the crank arm 322 about axis 322A, the crank arm 322 does not contact the stop switch as the second end moves past the switch 411 during the 360° revolution (as shown in FIG. 9). The stop switch 411 is not contacted until the contact surface 412 at the first end contacts the stop switch 411 at the end of the crank arm 332 revolution (360°) to stop operation of the motor assembly 42 at the completion of an operation cycle.

The motor assembly is slidably mounted to the frame 17 as shown in FIGS. 8A and 9 so that after the actuator contact members 342 and the stop contact members 344 engage additional motion produced by the motor assembly 42 is absorbed by the slidable attachment of the motor assembly 42 to the frame 17.

Figure 11:
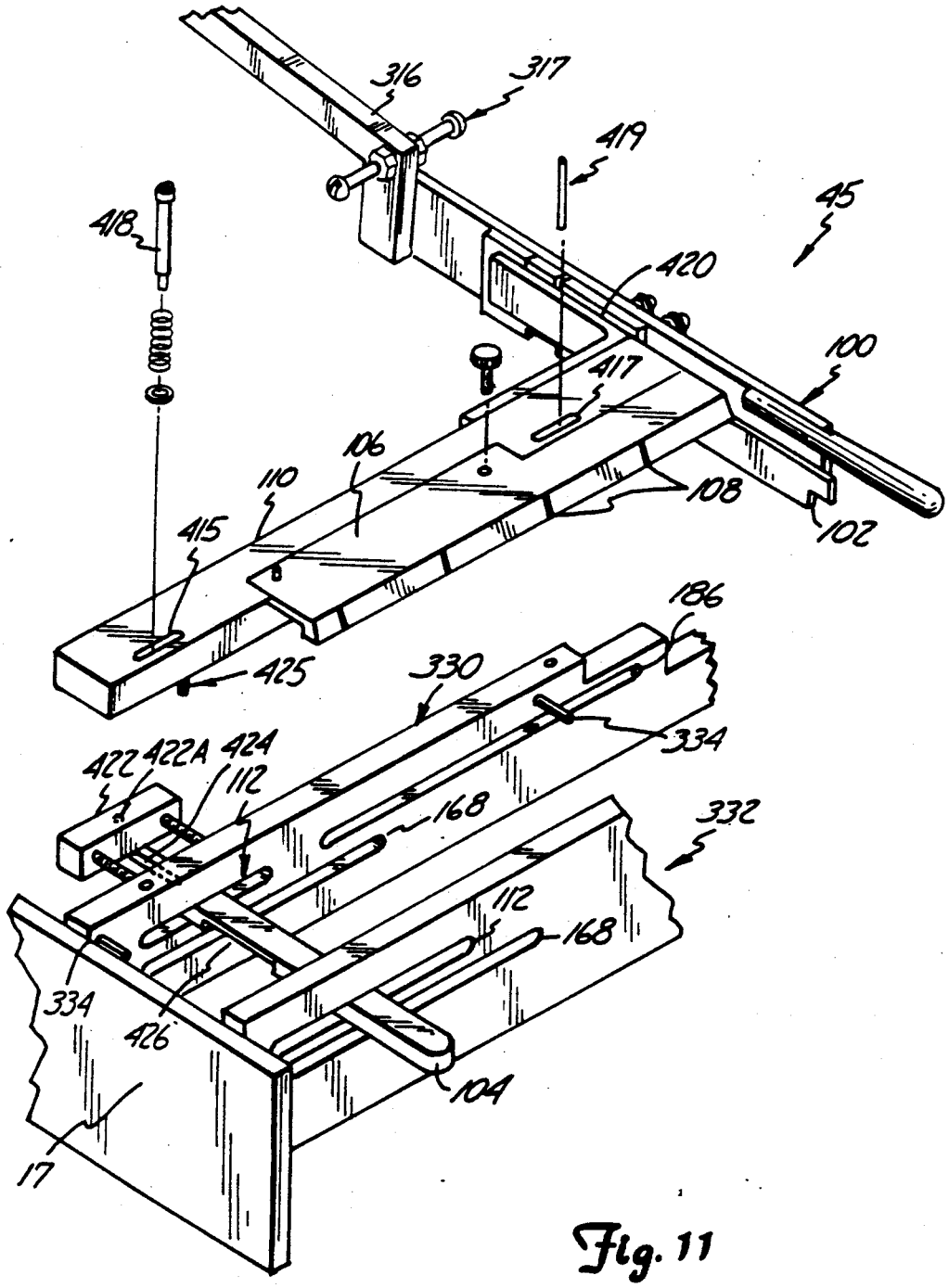
FIG. 11 is an exploded perspective view of the movable knife assembly and framing bar.

(13) Detailed Description of Movable Knife Assembly (FIG. 11)

As previously explained with reference to FIGS. 2 and 3, the knife assembly 45 is movably supported relative to the frame 17 for longitudinal adjustment. As shown in FIG. 11, and as previously explained, the framing bar support 110 is slidably mounted relative to the first track support 330 to movably support the framing bar 106 and the upper and lower knife blades 100 and 102. In particular, the framing bar support 110 includes first and second elongated mounting slots 415 and 417, the longitudinal extent thereof in parallel alignment with the framing bar 106. First and second mounting posts 418 and 419 extend through the first and second mounting slots 415 and 417 to slidably attach the framing bar support 110 to the first track support 330. The longitudinal extent of the mounting slots 415 and 417 defines an adjustment stroke for the framing bar 106 and the movable knife assembly 45.

The framing bar 106 is connected to the framing bar support 110 in parallel alignment therewith. An "L" shaped bracket 42 perpendicularly connects the pivotally connected upper and lower knife blades 100 and 102 to the framing bar support 110, (the framing bar support 110 is aligned parallel to the track supports 330 and 332) so that the upper and lower blades 100 and 102 are perpendicular to the advancing film 13.

The framing lever 104 is coupled to the framing bar support 110 to longitudinally adjust the position of the framing bar support 110 and accordingly, the framing bar 106 and the upper and lower knife blades 100 and 102. The lever 104 is pinned relative to the first track support 330 in cooperation with a mounting block 422. The mounting block 422 is attached to the first track support 330 via screws as shown in FIG. 11. The mounting block 422 includes a pin slot 422A. Lever 104 includes a pin (not shown) which extends through the pin slot 422A of the mounting block 422. The lever 104 includes an elongated slidable connection slot 424. The framing bar support 110 includes a connection pin 425. The connection pin 425 of the framing bar support 110 extends through the connection slot 424 of the lever 104 and is slidable therealong. The lever 104 extends through cooperating lever slots 112 of the first and second track supports 320 and 322. The lever 104 extends outside the frame 17 (as shown in FIG. 1) and is manually moved to pivot relative to the pin slot 422A of the mounting block 422 to slidably move the connection pin 425 along the connection slot 424 of the lever 104 to adjust the position of the framing bar support 110. The lever 104 has a recessed portion 426 to allow the actuator 195 and the shuttle contact member 175 to advance past the lever 104 during operation.

Prior to operation, the film web 13 supported by the shuttle bridging mechanism 120 is stationary. As previously described, the film frame delineations 12A are aligned with the film frame graduations 108 of the framing bar 106 to assure proper operation of the upper and lower knife blades 100 and 102 of the knife assembly 45. The film frame graduations 108 are aligned with the film frame delineations 12A by adjusting the framing lever 104. The framing lever 104 cooperatively adjusts the position of the framing bar 106 and the knife assembly 45. Once the film frame delineations 12A and the film frame graduations 108 of the framing bar 106 are aligned (FIG. 3), the shuttle film advance 160 and the shuttle bridging mechanism 120 cooperatively advance the film web 13 so that t he trailing edge 90A of the leading film transparency 90 is aligned with the upper and lower knife blades 100 and 102 of the knife assembly 45.

As shown in FIG. 8B, and previously explained, the operation of the upper and lower blades 100 and 102 of the knife assembly 45 is coupled to the operating lever 35 via the drive shaft 295.

Figure 12:
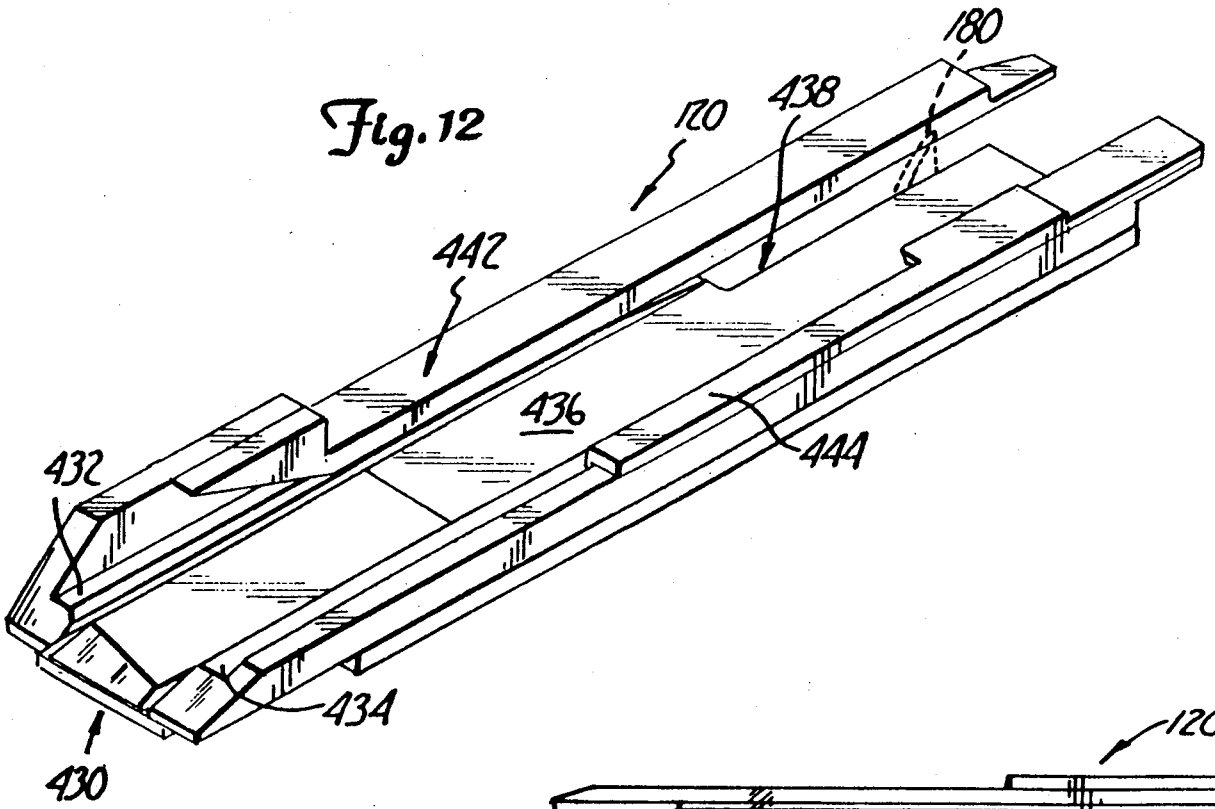
FIG. 12 is a top perspective view of the shuttle bridging mechanism.
Figure 13:
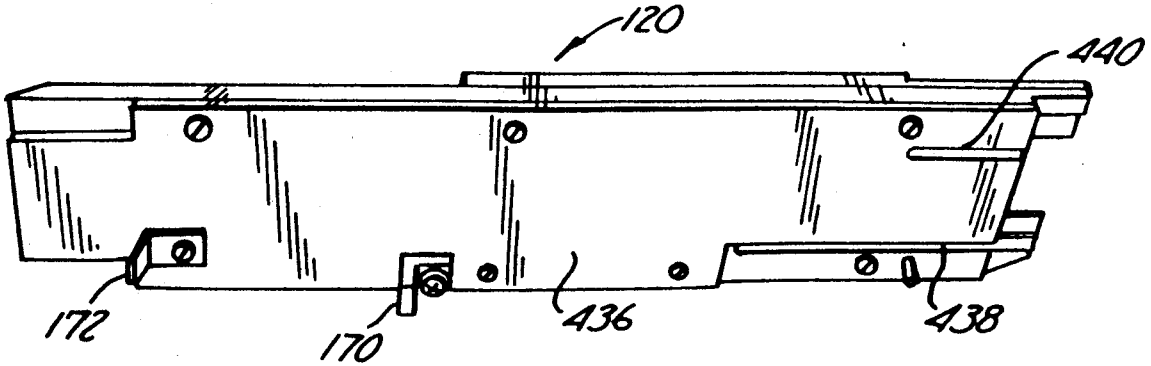
FIG. 13 is a bottom perspective view of the shuttle bridging mechanism.

(14) Detailed Description of Shuttle Bridging Mechanism (FIGS. 12 and 13)

FIG. 12 is a top perspective view of the shuttle bridging mechanism 120 supported between the first and second track supports 330 and 332 by bridging supports 334 (FIG. 8C). FIG. 13 is a bottom perspective view of the shuttle bridging mechanism 120.

As shown in FIGS. 12 and 13, the shuttle bridging mechanism 120 includes a film support defined by first and second film tracks 432 and 434 connected by a translucent connection member 436. The bridging mechanism 120 includes first and second finger slots 438 and 440 (slot 440 is not visible in FIG. 12) at an advanced end of the shuttle bridging mechanism 120. Mounted on top of the first and second film tracks 432 and 434 are first and second film caps 442 and 444, respectively. As shown in FIG. 13, the advancement contact member 170 and the retraction contact member 172 are mounted on a lower surface of the connection member 436 of the shuttle bridging mechanism 120.

The photographic film web 13 is supported by the first and second film tracks 432 and 434 and is maintained in position by the first and second film caps 442 and 444. The finger 180 of the shuttle film advance 160 extends through the first finger slot 438 to contact the film 13 supported by the shuttle bridging mechanism 120. In particular, the film tracks 432 and 434 support the film along the lateral edges thereof. The film tracks 432 and 434 extend to the finger slots 438 and 440. The film 13 is aligned and supported at the finger slots 438 and 440 by the fingers 180 (shuttle film advance 160) and 377 (fixed finger assembly 375). The fingers 180 and 377 of the shuttle film advance 160 and fixed finger assembly 375, respectively, extend through the finger slots 438 and 440, respectively, to engage the film 13. Preferably, the connection member 436 is formed of a translucent material to permit the film to be illuminated by a light source (not shown) below the shuttle bridging mechanism 120.

Figure 14:
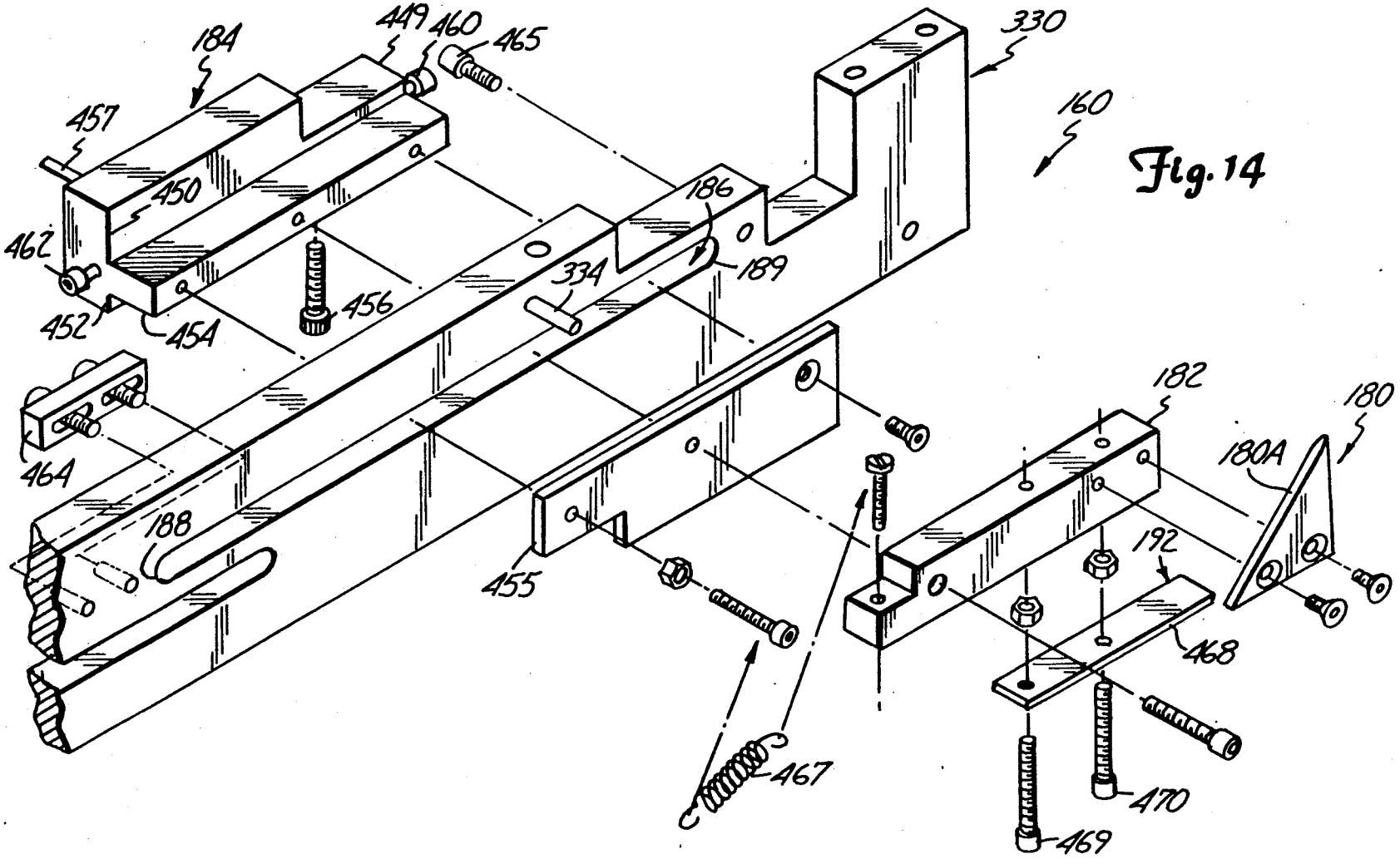
FIG. 14 is an exploded perspective view of the shuttle film advance of the slide mounter.

(15) Detailed Description of Shuttle Film Advance (FIG. 14)

As shown in FIG. 14, the shuttle film advance 160 is operable along the first track support 330 within the shuttle advance slot 186 to advance the film 13. As previously explained, the finger 180 is supported by the finger support 182 connected to the shuttle advance block 184.

The shuttle advance block 184 includes a T-shaped member 449, defining upper and lower shoulder portions 450 and 452 and a slide extension 454 and; a retaining plate 455. The slide extension 454 is configured for insertion into the shuttle advance slot 186 and is held in place by the retaining plate 455.

As previously explained in FIG. 8C, the retraction spring 357 is attached to pin 456 to normally bias the shuttle advance block 184 toward the retracted end 188 of the shuttle advance slot 186 (FIGS. 6A and 9). The pulley cable 356 of the pulley assembly 294 (FIG. 8C) is connected to the shuttle advance 184 at pin 457 to advance the shuttle film advance 160 toward the advanced end 189 of the shuttle advance slot 186 (FIG. 5A and 8C).

The shuttle advance block 184 also includes forward and rear stop contacts 460 and 462, respectively, An adjustable rear stop block 464 is adjustably mounted to the first track support 330 to cooperate with the rear stop contact 462 mounted to the shuttle advance block 184 to define the retracted position for the shuttle film advance 160. A forward contact 465 is mounted to the track support 330 adjacent to the advanced end 189 of the actuator slot 186 and cooperates with the forward stop contact 460 of the shuttle advance block 184 to define the advanced position for the shuttle film advance 160. The operation of the shuttle advance block 184 between the adjustable stop block 464 and the forward contact 465 defines the advancement stroke for the shuttle film advance 160. The adjustable rear stop block 464 is finely adjusted so that the advancement stroke defined advances the trailing edge 90A of the leading film transparency 90 (aligned with the frame graduations 108 of the framing bar 106, FIG. 3) across the upper and lower knife blades 100 and 102 of the knife assembly 45.

As shown in FIG. 14, the finger support 182 is pivotally mounted to the retaining plate 455 of the shuttle advance block 184 and is normally spring biased upward by a spring 467 connected at one end to the retaining plate 455 and at the other end to the finger support 182 to engage the film.

As previously explained, the finger 180 extends through the finger slot 438 of the shuttle bridging mechanism 120 (FIG. 12) to engage the film supported thereby during operation. The spring release assembly 192 (shown in FIGS. 5A and 6A) is defined by a finger release bar 468 connected to a lower surface of the finger support 182 by attachments 469 and 470. As shown in FIGS. 5A and 6A, the position control lever 390 is coupled to the finger release assembly 192 to manually release the finger 180 of the shuttle film advance 160. That is, when the position control lever 390 is depressed, the position control lever 390 contacts the actuator 195 to lower the actuator 195. As the actuator 195 is lowered, the roller 194 (FIGS. 5A and 6A) mounted at a forward end thereof is lowered to contact the finger release bar 468 of the spring release assembly 192 to release the finger 180 from the film. Depression of the position control lever 390 simultaneously releases the fixed finger assembly 375 attached thereto (FIG. 15).

Figure 15:
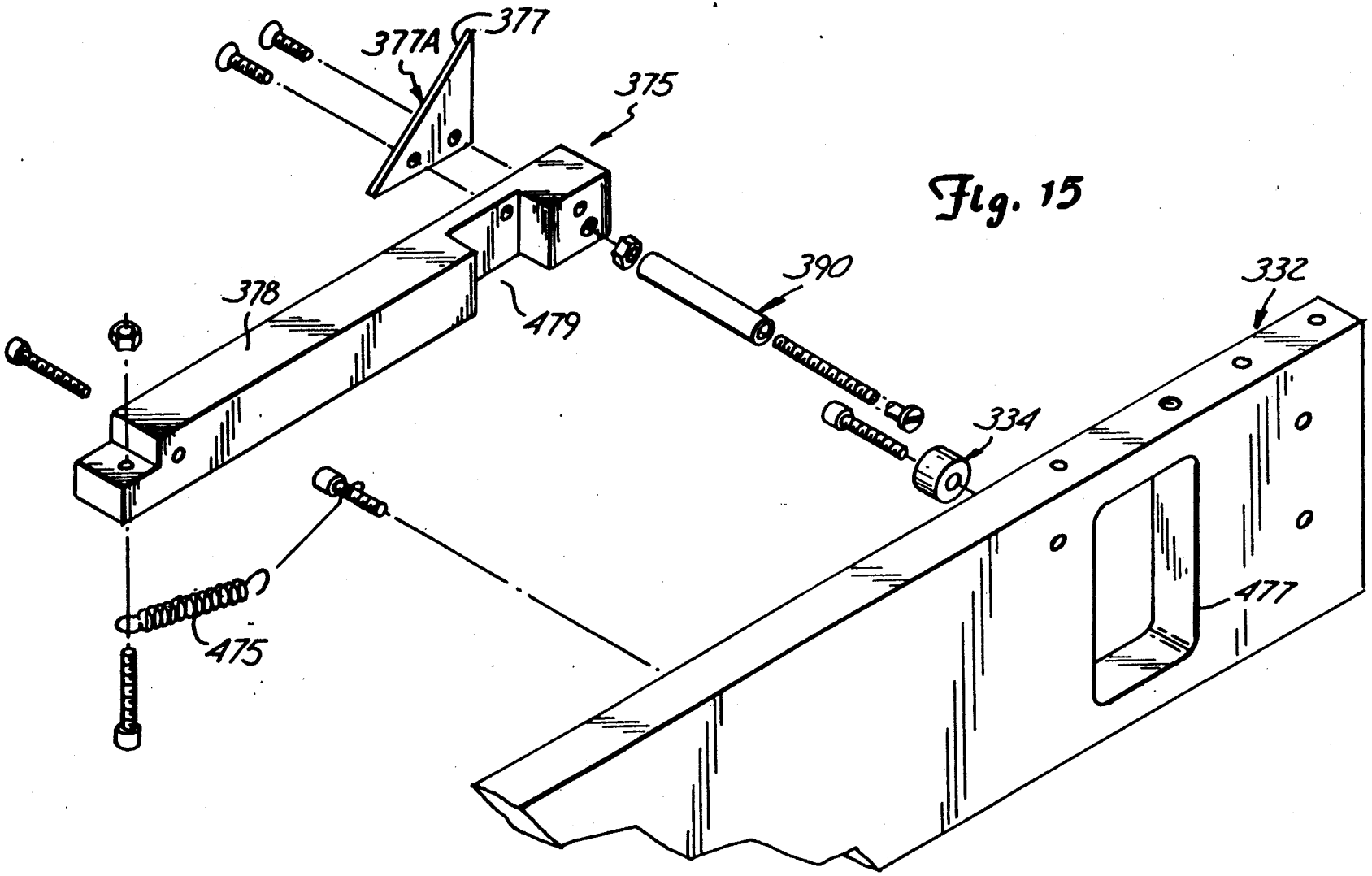
FIG. 15 is an exploded perspective view of a fixed finger assembly.
Figure 16:
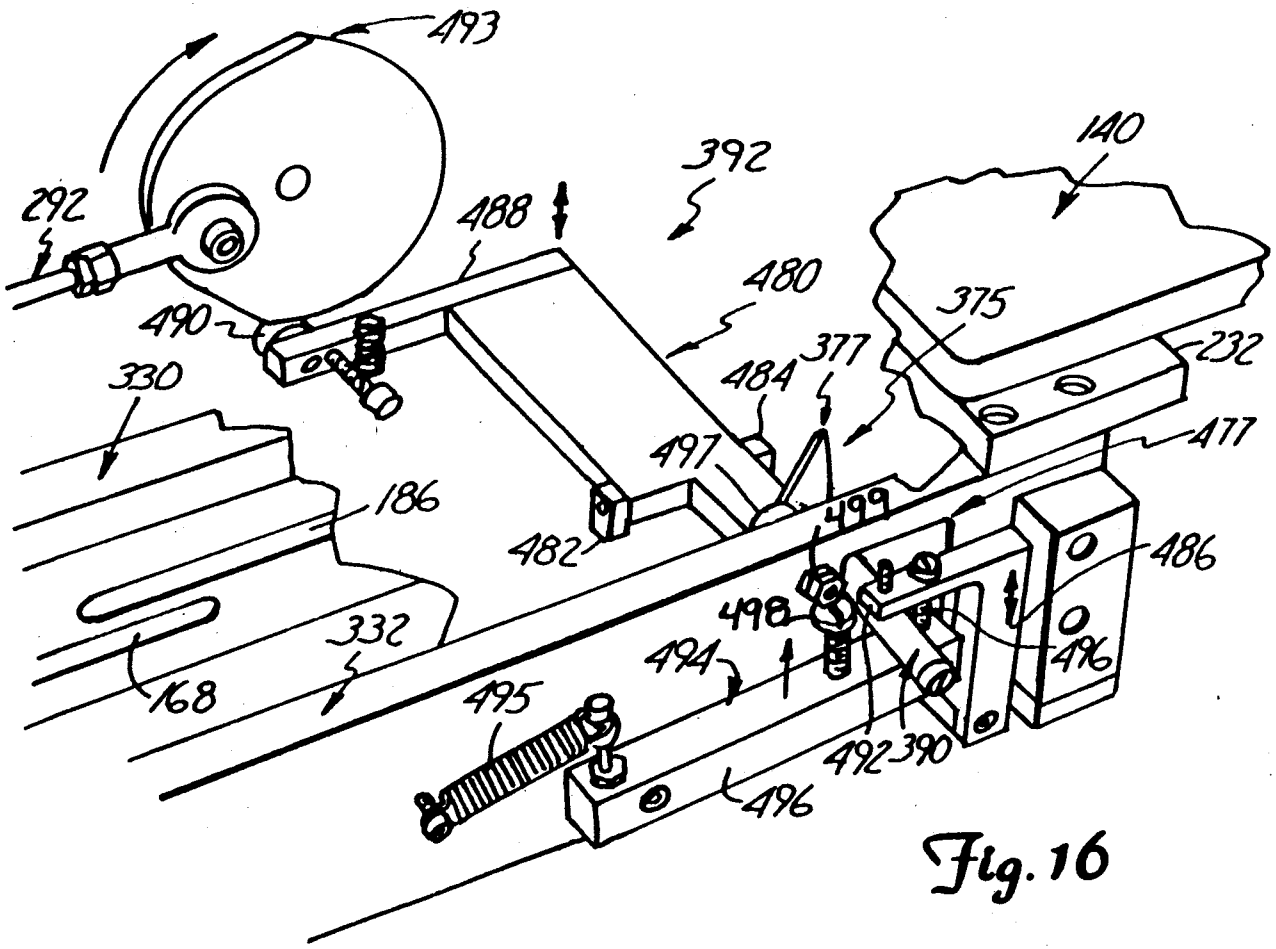
FIG. 16 is a perspective view of the fixed finger control assembly.

(16) Detailed Description of Fixed Finger (FIGS. 15 and 16)

As shown in FIG. 15, the fixed finger support 378 of the fixed finger assembly 375 is pivotally mounted to the second track support 332 and normally spring bias upward by spring 475. The fixed finger 377 includes a tapered surface 377A in the direction of advancement of the film 13 to permit the finger 377 to be forced downward out of alignment with the film when the tapered surface 377A is contacted. The second track support 332 includes a through opening 477 through which the control lever 390 attached to the finger support 378 extends so that the control lever 390 is accessible for manual manipulation. The finger support 378 includes a recessed cavity 479 to accommodate for the shuttle bridging support 334 mounted to the track support 332 thereat.

FIG. 16 is an exploded perspective view of the fixed finger control assembly 392. As previously explained, the fixed finger control assembly 392 contacts the control lever 390 of the fixed finger assembly 375 to position the finger 377 (out of alignment with the film plane) during operation. In particular, the finger 377 is normally spring biased upward by spring 475 (FIG. 15) to engage the film 13. The fixed finger control assembly 392 contacts the control lever 390 to force the finger 377 downward and out of alignment of the film plane. The fixed finger 377 is forced out of alignment of the film plane to facilitate operation (advancement toward the insertion station 40) of the shuttle film advance 160. The fixed finger 377 engages the film (while spring biased upward by spring 475) to maintain the position of the film 13 while the shuttle bridging mechanism 120 operates and while the shuttle film advance 160 is retracted.

As shown in FIG. 16, the fixed finger control assembly 392 includes a pivot plate 480 pivotally mounted to the frame 17 at blocks 482 and 484 and a "L" shaped extension 486. A contact extension 488 is mounted to a first end of the pivot plate 480 to support a contact 490 at the first end. The second end of the pivot plate extends through the through opening 477 of the second track support 332 and supports the "L" shaped extension 486 so that an extension leg 492 of the "L" shaped extension 486 engages the control lever 390 of the fixed finger assembly 375 to force the finger 377 out of alignment with the advancing film. Thus, the pivot plate 480 is alternately pivoted to position the "L" shaped extension 486 to alternately engage or disengage the control lever 390 of the finger assembly 375 as necessary.

The first end of the pivot plate 480 is normally spring biased upward so that the "L" shaped extension 486 normally engages the control lever 390 to force the finger 377 out of alignment with the film plane. When the first end of the pivot plate 480 is forced downward against the spring bias, the "L" shaped extension 486 is raised to release the control lever 390 and disengage the fixed finger 377 from the film 13.

In operation, the position of the pivot plate 480 is controlled in cooperation with the motor assembly 42. In particular, a cam plate 493 of the crank arm 322 is designed to contact the contact 490 on the pivot plate 480 during certain intervals during the first and second operation phases of the motor assembly 42. When the cam plate 493 contacts the contact 490, the pivot plate 480 is forced against the spring bias to release the extension 486 from the control lever 390 to force (via spring 475, FIG. 15) the finger assembly 375 and the finger 377 upward in alignment with the film plane to engage the film to maintain the position thereof. Alternatively, when the cam plate 493 is not contacting the contact 490, the normally spring biased pivot plate 480 forces the "L" shaped extension 486 downward to contact the control lever 390 to force the finger assembly 375 and finger 377 out of alignment with the film plane so that the film 13 can advance past during operation of the shuttle film advance 160.

Figure 17:
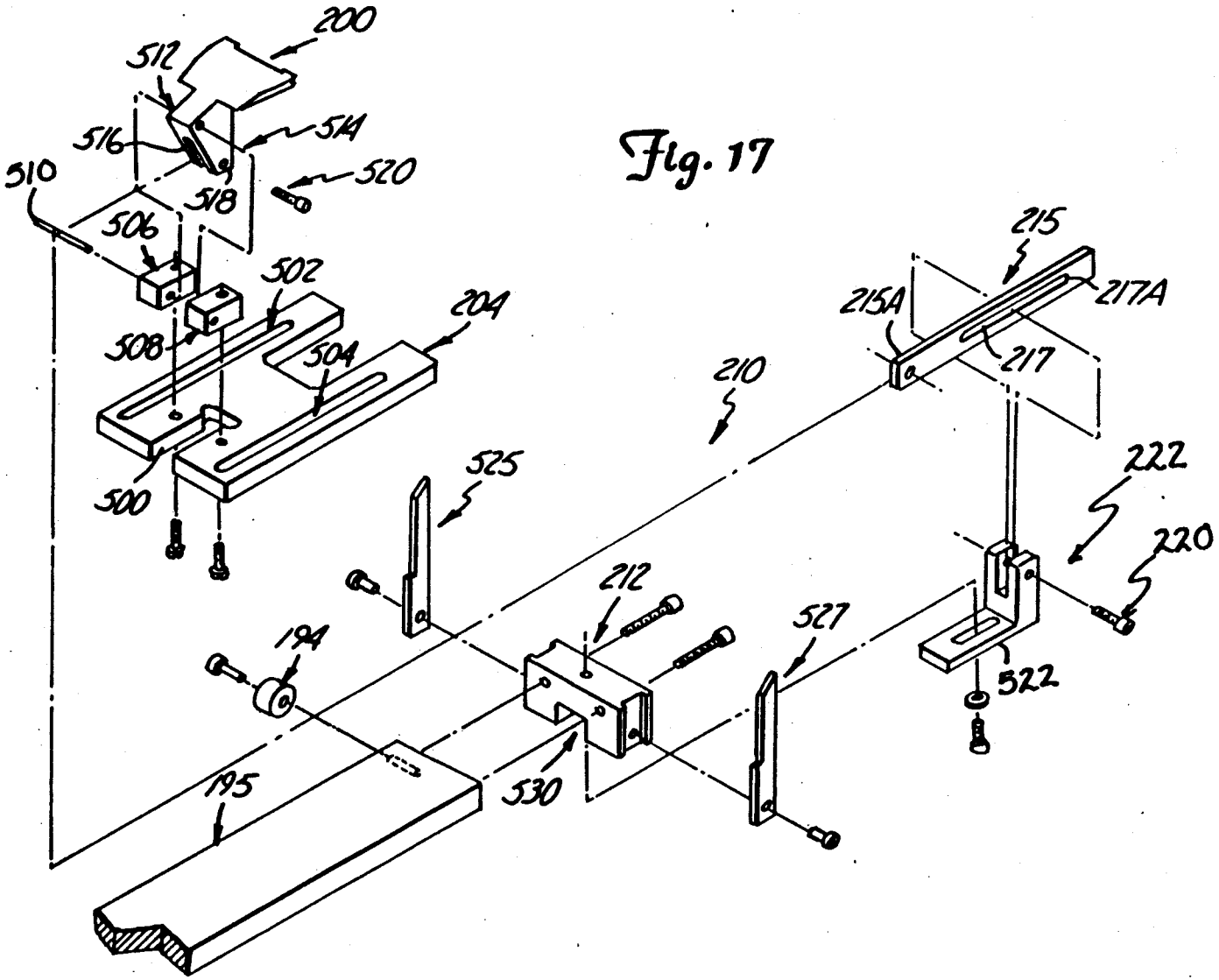
FIG. 17 is an exploded perspective view of the pusher/finger assembly for inserting a severed film transparency into the slide mount at the insertion station.

(17) Detailed Description of the Pusher/Finger Assembly (FIG. 16 and 17)

As explained (FIGS. 5A & 6A), the pusher/finger assembly 162 is supported at a forward end of the actuator 195. The forward end of the actuator 195 (and accordingly the pusher/finger 162) is supported and spring biased upward by a spring biased contact assembly 494 (FIG. 16). The spring bias contact assembly 494 includes a spring 495, a support member 496 and a contact roller 497. The contact roller 497 is connected to the support member 496 and extends through opening 477 in alignment with the film 13. The upward bias of spring 495 forces the contact roller 497 upward against a lower surface of actuator 195 to provide upward tension to the actuator 195 and thus the pusher/finger assembly 162 supported thereby. Screws 498 (mounted to the support member 496) and 499 (mounted to the second track support 332) are used to adjust the upward tension applied to the actuator 195 via the contact roller 497.

FIG. 17 is a detailed exploded perspective view of the pusher/finger assembly 162, the operation of which is described in sections (7) and (10) in relation to FIGS. 5B and 6B. The movable pusher support 204 of the pusher/finger assembly 162 is generally "H" shaped to define a slotted rear portion 500. The movable pusher support 204 includes first and second finger slots 502 and 504 along the legs of the "H". First and second support blocks 506 and 508 are attached to the movable pusher support 204 on either side of the rear slot 500.

The pusher 200 is pivotally supported by the movable pusher support 204 by a pivot rod 510 which extends between the support blocks 506 and 508 and through a pivot slot 512 of the pusher 200 to connect the pusher 200 to the pusher support 204 and define a pivot axis therefor. A stem portion 514 of the pusher 200 extends below the pivot slot 512 and extends through the rear slotted portion 500 of the pusher support 204. The stem portion 514 of the pusher 200 includes a rectangular slot 516 and a screw hole 518 extending therethrough. The link bar 215 is seated within the rectangular slot 516 of the stem 514. A screw 520 extends through the screw hole 518 of the pusher 200 and a corresponding screw hole 215A of the link bar 215 to attach the link bar 215 to the stem 514 of the pusher 200 some distance removed from the pivot axis (at 512).

As shown, the finger assembly 203 includes first and second fingers 525 and 527 attached to either side of the rectangular shaped finger support 212. The fingers 525 and 527 are supported below the movable pusher support 204 (in cooperation with the actuator 195) and extend through the first and second finger slots 502 and 504 of the support 204, respectively, to contact the film transparency 12.

The fingers 525 and 527 extend between the film receiving supports 230 and 232 and the parallel ledges 236 cooperating therewith to engage the film supported by the support ledges 234 and the parallel supports 236 as described in reference to FIG. 7. An upward tension is provided by the spring biased contact assembly 494 (FIG. 16) via the actuator 195 to engage the first and second fingers 525 and 527 with the film 13. When the actuator 195 (roller 194) engages the ramped surface 224 as shown in FIG. 6A, the fingers 525 and 527 are lowered from the film plane and the finger slots 502 and 504. The finger support 212 includes a lower rectangular receiving slot 530 and is attached to a leading end of the actuator 195.

The connecting rod support 222 includes a mounting extension 532 which extends through the rectangular receiving slot 530 of the finger support 212 to operably attach the connecting rod support 222 to the actuator 195. As previously explained, the actuator 195 cooperatively advances the connecting rod 220 with the finger support 212 so that the connecting rod 220 contacts the contact end 217A of the stroke slot 217. When the connecting rod 220 contacts the contact end 217A of the stroke slot 220 further advancement of the actuator 195 is transferred, via the link bar 215, to the pusher 200 to rotate the pusher 200 about the pivot axis. In particular, the pusher 200 is rotated from the retracted position (FIG. 5B) to the engaging position (FIG. 6B) to advance the film transparency 12.

Thereafter, when the connecting rod 220 engages the contact end 217A of the stroke slot 217, the movable pusher support 204 is advanced along the pusher track 206 toward the insertion station 40, in cooperation with the actuator 195, to advance the pusher 200 connected to a rear portion thereof. FIGS. 5B and 6B comparatively illustrate the advancement of pusher 200 along the pusher track 206 to insert a severed film transparency into a slide mount 15 at the insertion station 40.

As shown in FIG. 4, track blocks 540 and 542 having track slots 544 and 546, respectively, extending therealong, cooperate to define the pusher track 206. The track slots 544 and 546 extend below the film receiving supports 230 and 232 along the extent thereof and extend into the insertion station 40.

A leaf spring (not shown) is upwardly biased against a lower surface of the pusher support 204 to provide drag therefor. The drag introduced by the spring assures that the pusher 200 fully pivots from the retracted position (FIG. 5B) to the engaging position (FIG. 6B) before the pusher support 204 is advanced along the pusher track 206.

(18) Conclusion

As described, the slide mounter 10 of the present invention automatically advances a photographic film web to sever a single film transparency therefrom and insert the severed film transparency into a slide mount to prepare a photographic slide. For each operation cycle of the semi-automatic slide mounter, the operating lever 35 is advanced forward to eject a single slide mount 15 from the slide magazine 25 and sever the leading film transparency (positioned across the upper and lower knife blades 100 and 102 during a previous operation cycle) from the photographic film web for insertion into the ejected slide mount (FIG. 6B). When the operating lever is released, the slide ejector is retracted from an ejection position to contact a start switch to initiate operation of the motor assembly 42.

In operation, (FIGS. 8A and 9) the motor assembly 42 operates the drive lever 165 operably connected to the shuttle bridging mechanism 120, the shuttle film advance 160 and the pusher/finger assembly 162. In particular, the drive lever 165 is advanced forward from the rest position to advance the shuttle bridging mechanism 120 to support the film web 13 across the upper and lower knife blades 100 and 102 and the longitudinal adjustment clearance of the knife assembly 45. At the same time, the pusher/finger assembly 162 advances to insert the film transparency, severed during operation of the operating lever 35, into the ejected slide mount. The shuttle film advance 160 operates as the drive lever 165 is retracted from the forward position to the rest position, via the pulley assembly 294, to advance the film supported by the shuttle bridging mechanism 120 along an advancement stroke to align the leading film transparency with the upper and lower knife blades 100 and 102 of the knife assembly 45.

The knife assembly 45 is slidably mounted relative to the first and second track support 330 and 332 to adjust the longitudinal position of the knife assembly 45 relative to the supported film. The position of the knife assembly 45 is adjusted so that when the film is advanced by the shuttle bridging mechanism 120 and the shuttle film advance 160, the knife assembly will properly sever the leading film transparency 90 from the photographic film web 13.

Accordingly, the shuttle bridging mechanism 120 operates between a retracted position and an advanced position to alternately support the film, in the advanced position, across the support gap defined by the upper and lower knife blades 100 and 102 (including the longitudinal adjustment clearance of the knife assembly 45) while the film is advanced and to permit operation of the knife assembly 45 in the retracted position.

Although the present invention has been described with reference to a preferred embodiment, workers skilled in the art will recognize that changes may be made in form and detail without departing from the spirit and scope of the invention.

What is claimed is:

1. A slide mounter apparatus for preparing photographic slides containing individual film transparencies of a photographic film web, the apparatus being of a type having a knife assembly including upper and lower knife blades which operate between an opened receiving position and a closed cutting position for severing individual film transparencies from the film web, in which the film web is longitudinally supported along a film plane aligned with the knife assembly and longitudinally advanced across a support gap defined at the upper and lower knife blades to align a trailing edge of a leading film transparency with the upper and lower knife blades of the knife assembly so that the leading film transparency can be severed from the film web by the knife assembly, an improvement comprising:

a shuttle bridging mechanism for longitudinally supporting the film web in the film plane, the shuttle bridging mechanism operably supported relative to a frame to longitudinally move between a retracted position, out of alignment with the knife blades, and an advanced position extending across the support gap of the knife blades to support the film thereacross;

means for longitudinally moving the shuttle bridging mechanism toward the knife assembly from the retracted position to the advanced position when the upper and lower blades are separated in opened receiving position;

means for longitudinally advancing the film web toward the knife assembly to align the trailing edge of the leading film transparency with the upper and lower knife blades; and means for longitudinally moving the shuttle bridging mechanism away from the knife assembly from the advanced position to the retracted position, when the trailing edge of the leading film transparency is aligned with the upper and lower knife blades, to permit operation of the knife assembly in the closed cutting position.

2. The apparatus of claim 1 and further including means for operating the knife assembly between the opened receiving position and the closed cutting position to sever the leading film transparency from the film web.

3. The apparatus of claim 1 wherein the means for longitudinally advancing the film web toward the knife assembly includes a shuttle film advance which advances the film web along the shuttle bridging mechanism toward the knife assembly while the shuttle bridging mechanism is in the advanced position extending across the support gap.

4. The apparatus of claim 3 in which the shuttle film advance includes:

a finger designed to engage the photographic film web supported by the shuttle bridging mechanism and operably supported to move between a retracted position and an advanced position to advance the film toward the knife assembly to align the trailing edge of the leading film transparency with the upper and lower knife blades of the knife assembly; and means for moving the finger between the retracted position and the advanced position to align individual film transparencies with the upper and lower knife blades.

5. The apparatus of claim 4 wherein the shuttle bridging mechanism includes an elongated finger slot through which the finger extends and along which the finger moves to contact and advance the supported film.

6. The apparatus of claim 1 wherein the means for moving the shuttle bridging mechanism between the retracted position and the advanced position includes:

an advancement contact member and a retraction contact member mounted to the shuttle bridging mechanism; and drive means designed to alternately contact the advancement contact member and the retraction contact member to move the shuttle bridging mechanism between the retracted position and the advanced position.

7. The apparatus of claim 1 wherein the shuttle bridging mechanism includes:

first and second film tracks for supporting the photographic film web along the lateral edges thereof; and a connection member for supporting the first and second film tracks.

8. A slide mounting apparatus for mounting a photographic film transparency from a photographic film web into a slide mount to prepare a photographic slide, the apparatus comprising:

a frame;

a knife assembly having upper and lower knife blades aligned with the longitudinally supported film web, the knife blades being operable between an opened receiving position and a closed cutting position;

first and second parallel track supports, supported by the frame, the second track support being spaced from the first track support;

a shuttle bridging mechanism for longitudinally supporting a photographic film web in the film plane;

means for movably supporting the shuttle bridging mechanism parallel to and between the first and second track supports, the shuttle bridging mechanism being movable along the track supports toward the knife assembly aligned therewith, between a retracted position out of alignment with the knife blades, and an advanced position extending across a support gap defined at the upper and lower knife blades to support the film thereacross;

a slide magazine for holding a plurality of slide mounts for operation;

means for ejecting a slide mount from the slide magazine and advancing the slide mount to an insertion station;

means for moving the shuttle bridging mechanism toward the knife assembly from the retracted position to the advanced position when the upper and lower knife blades are separated in the opened receiving position;

means for advancing the supported film web toward the knife assembly to align the trailing edge of a leading film transparency with the upper and lower knife blades;

means for moving the shuttle bridging mechanism away from the knife assembly from the advanced position to the retracted position, when the trailing edge of the leading film transparency is aligned with the upper and lower knife blades, to permit operation of the knife assembly in the closed cutting position;

means for operating the knife assembly between the opened receiving position and the closed cutting position to sever the leading film transparency from the film web; and means for inserting the severed film transparency into the ejected slide mount at the insertion station.

9. The apparatus of claim 8 wherein the means for movably supporting the shuttle bridging mechanism includes:

bridging supports attached to and extending between the first and second track supports.

10. The apparatus of claim 8 wherein the means for moving the shuttle bridging mechanism between the retracted position and the advanced position includes an advancement contact member and a retraction contact member mounted to the shuttle bridging mechanism; and drive means for alternately contacting the advancement contact member and the retraction contact member to move the shuttle bridging mechanism between the retracted position and the advanced position.

11. The apparatus of claim 10 wherein the drive means for alternately contacting the advancement contact member and the retraction contact member to move the shuttle bridging mechanism includes:

a drive lever operably supported to move between a rest position and a forward position;

a shuttle contact member connected to the drive lever and movable therewith, the shuttle contact member aligned with the advancement contact member and the retraction contact member of the shuttle bridging mechanism to move the shuttle bridging mechanism between the retracted position and the advanced position when the drive lever is moved between the rest position and the forward position; and motorized drive means for operating the drive lever between the rest position and the forward position.

12. The apparatus of claim 8 wherein the means for longitudinally advancing the film web toward the knife assembly includes a shuttle film advance which advances the film web along the shuttle bridging mechanism toward the knife assembly while the shuttle bridging mechanism is in the advanced position extending across the support

13. The apparatus of claim 12 wherein the shuttle film advance includes:

a finger for engaging the photographic film web supported by the shuttle bridging mechanism and operably supported to move between a retracted position and an advanced position to advance the film toward the knife assembly to align the trailing edge of the leading film transparency with the upper and lower knife blades of the knife assembly; and means for moving the finger between the retracted position and the advanced position to align individual film transparencies with the upper and lower knife blades.

14. The apparatus of claim 12 wherein the shuttle bridging mechanism includes an elongated finger slot through which the finger of the shuttle film advance extends and along which the finger moves to contact and advance the supported film.

15. The apparatus of claim 14 wherein the shuttle film advance is operably supported within and movable along a shuttle film advance slot along one of said track supports and includes:

a shuttle advance block for supporting the finger, the shuttle advance block having a shuttle support extension designed to extend through and move along the shuttle film advance slot to move the finger between the retracted position and the advanced position for advancing the film toward the knife assembly to align the trailing edge of the leading film transparency with the upper and lower knife blades.

16. The apparatus of claim 15 wherein the means for moving the finger between the retracted position and the advanced position includes:

a retraction spring attached at a first end to the shuttle advance block and at a second end to the frame, the retraction spring forcing the finger to the retracted position; and coupled with the drive a pulley assembly lever and the shuttle advance block to move the finger to the advance position in cooperation with the operation of the shuttle bridging mechanism, wherein the finger of the shuttle film advance is advanced along the finger slot of the shuttle bridging mechanism to advance the photographic film web supported thereby.

17. A method for severing individual film transparencies from a photographic film web and inserting the severed film transparencies into a photographic slide mount to prepare a photographic slide, the method comprising the steps of:

supporting a photographic film web on a shuttle bridging mechanism along a longitudinal film plane, the shuttle bridging mechanism being aligned with and operably supported to move toward and away from a knife assembly having upper and lower knife blades which operate between an opened receiving position and a closed cutting position;

moving the shuttle bridging mechanism towards the knife assembly to position the shuttle bridging mechanism across a support gap defined at the upper and lower knife blades to support the film thereacross;

advancing the photographic film web along the shuttle bridging mechanism until a trailing edge of a leading film transparency aligns with the upper and lower knife blades of the knife assembly;

moving the shuttle bridging mechanism away from the knife assembly and away from across the support gap to permit operation of the upper and lower knife blades in the closed cutting position;

operating the knife blades of the knife assembly between the opened receiving position and the closed cutting position to sever the advanced film transparency from the photographic film web; and inserting the severed film transparency into a slide mount.

* * * * *

UNITED STATES PATENT AND TRADEMARK OFFICE

CERTIFICATE OF CORRECTION

PATENT NO. : 5,187,918

DATED : February 23, 1993

INVENTOR(S) : WILBUR GERRANS

It is certified that error appears in the above-identified patent and that said Letters Patent is hereby corrected as shown below:

Col. 26, line 10, delete "coupled with the drive"

Col. 26, line 11, after "pulley assembly", insert--
coupled with the drive--

Signed and Sealed this

Sixteenth Day of November, 1993

*Attest:*

Bruce Lehman

BRUCE LEHMAN

*Attesting Officer*

*Commissioner of Patents and Trademarks*